US007125189B2

(12) United States Patent
Gueret

(10) Patent No.: US 7,125,189 B2
(45) Date of Patent: Oct. 24, 2006

(54) DEVICE, SYSTEM, AND METHOD FOR APPLYING A PRODUCT

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/298,609

(22) Filed: Nov. 19, 2002

(65) Prior Publication Data

US 2003/0129016 A1 Jul. 10, 2003

(30) Foreign Application Priority Data

Nov. 19, 2001 (FR) ..... 01 14928

(51) Int. Cl.
*B43K 5/00* (2006.01)
*B43K 8/12* (2006.01)

(52) U.S. Cl. ..... 401/202; 401/207

(58) Field of Classification Search ..... 401/202, 401/205, 206, 187, 188 R, 196, 200, 201, 401/203, 204, 207
See application file for complete search history.

(56) References Cited

U.S. PATENT DOCUMENTS 802,484 A * 10/1905 Speir ..... 401/131
1,315,305 A * 9/1919 Hegland ..... 401/148
1,918,215 A * 7/1933 Runnels ..... 401/132
2,659,919 A * 11/1953 McCabe et al. ..... 220/522
2,837,756 A * 6/1958 Barlow et al. ..... 15/105
2,841,809 A * 7/1958 Oliver ..... 132/74.5
2,853,727 A * 9/1958 Nadai ..... 401/199
2,975,464 A * 3/1961 Schultz ..... 206/229
3,010,138 A 11/1961 Nadai
3,054,133 A 9/1962 Hublard et al.
3,084,375 A * 4/1963 Schwartzman ..... 401/206
3,113,336 A * 12/1963 Langnickel ..... 401/198
3,129,452 A * 4/1964 Schwartzman ..... 264/249
3,132,370 A * 5/1964 Capezzuto ..... 401/183
3,133,309 A * 5/1964 Miles ..... 401/202
3,266,079 A * 8/1966 Schwartzman ..... 401/202
3,444,808 A * 5/1969 Schwartzman ..... 101/125
3,463,597 A * 8/1969 Wakai ..... 401/206

(Continued)

FOREIGN PATENT DOCUMENTS

DE 3625418 2/1988

(Continued)

OTHER PUBLICATIONS

English language Derwent Abstract of EP 1 094 011, Apr. 25, 2001.

(Continued)

*Primary Examiner*—David J. Walczak
(74) *Attorney, Agent, or Firm*—Finnegan, Henderson, Farabow, Garrett & Dunner, LLP

(57) ABSTRACT

A device for applying a product may include a container configured to contain a product, a duct associated therewith, and an applicator. The applicator may include a side wall, a substantially closed first end defining an application surface, and an open second end. The duct may define an axis and a passage in communication with the container. A portion of the axial length of the applicator may be located around the duct. The applicator may be configured such that, when the applicator and the container are coupled together, at least one cavity is formed between a free end of the duct and an internal surface of the applicator, and at least one portion of the applicator has a thickness along a direction of the axis of the duct that is less than the thickness of the side wall in a direction substantially perpendicular to the axis of the duct.

115 Claims, 11 Drawing Sheets

U.S. PATENT DOCUMENTS

| | | | | | |
|---|---|---|---|---|---|
| 3,601,287 | A | * | 8/1971 | Schwartzman | 222/146.2 |
| 3,661,468 | A | * | 5/1972 | Schwartzman | 401/206 |
| 3,663,113 | A | * | 5/1972 | Frain et al. | 401/206 |
| 4,225,253 | A | * | 9/1980 | Fraleigh | 401/9 |
| 5,018,894 | A | * | 5/1991 | Goncalves | 401/202 |
| 5,073,057 | A | * | 12/1991 | Lathrop et al. | 401/206 |
| 5,082,386 | A | * | 1/1992 | Hironaka et al. | 401/206 |
| 5,163,767 | A | | 11/1992 | Lucas | |
| 5,230,579 | A | | 7/1993 | Klawson et al. | |
| 5,967,685 | A | * | 10/1999 | De Laforcade | 401/190 |
| 6,164,858 | A | | 12/2000 | Kaufmann | |
| 6,386,781 | B1 | * | 5/2002 | Gueret | 401/198 |
| 6,547,471 | B1 | | 4/2003 | Tucker et al. | |
| 6,659,109 | B1 | | 12/2003 | Noa | |
| 2001/0031171 | A1 | | 10/2001 | Delage | |
| 2002/0054783 | A1 | | 5/2002 | Gueret | |
| 2003/0041872 | A1 | | 3/2003 | Noa | |

FOREIGN PATENT DOCUMENTS

| | | |
|---|---|---|
| EP | 0 155 350 | 9/1985 |
| EP | 0 872 193 | 10/1988 |
| EP | 0 155 350 B1 | 12/1988 |
| EP | 0 390 922 | 10/1990 |
| EP | 0 875 465 | 11/1998 |
| EP | 1 094 011 | 4/2001 |
| EP | 1 125 517 | 8/2001 |
| FR | 1461651 | 12/1966 |
| FR | 2 829 000 | 3/2003 |
| JP | A S60-90153 | 5/1985 |
| JP | 3061747 | 6/1999 |
| JP | A 2001-161436 | 6/2001 |
| JP | A 2001-269221 | 10/2001 |
| KR | 20-0262453 | 1/2002 |
| KR | 10-2004-0009670 | 1/2004 |
| WO | WO 98/39991 | 9/1998 |
| WO | WO 02/08082 A1 | 1/2002 |

OTHER PUBLICATIONS

Amendment filed in the USPTO on Sep. 29, 2003, in U.S. Appl. No. 09/691,944, filed Oct. 20, 2000.
Office Action mailed by the USPTO on Jun. 30, 2003, in U.S. Appl. No. 09/691,944, filed Oct. 20, 2000.
Office Action mailed by the USPTO on Mar. 26, 2003, in U.S. Appl. No. 09/691,944, filed Oct. 20, 2000.
Amendment After Final filed Mar. 10, 2003, in U.S. Appl. No. 09/691,944, filed Oct. 20, 2000.
Office Action mailed by the USPTO on Dec. 10, 2002, in U.S. Appl. No. 09/691,944, filed Oct. 20, 2000.
Amendment filed in the USPTO on Sep. 13, 2002, in U.S. Appl. No. 09/691,944, filed Oct. 20, 2000.
Office Action mailed by the USPTO on Jun. 14, 2002, in U.S. Appl. No. 09/691,944, filed Oct. 20, 2000.
Response to Election of Species Requirement filed on Mar. 5, 2002, in U.S. Appl. No. 09/691,944, filed Oct. 20, 2000.
Election of Species Requirement mailed by the USPTO on Feb. 5, 2002, in U.S. Appl. No. 09/691,944, filed Oct. 20, 2000.
U.S. Appl. No. 09/691,944, filed Oct. 20, 2000.
English language Derwent Abstract for DE 3625418.
Color photographs (ten) of a sample of a cosmetic product application arrangement disclosed on or about Jun. 25, 2002.
Notice of Rejection, and its English-language translation, for JP 2002-335839, issued Nov. 2, 2004, by the Japanese Patent Office.
English-language Abstract of JP-A 2001-161436.
English-language translation of FR 1,461,651 (3 pages).

* cited by examiner

DEVICE, SYSTEM, AND METHOD FOR APPLYING A PRODUCT

The present invention relates to a device for applying a product, for example, products in liquid form or powder form. For example, the invention relates a device for applying cosmetic products (e.g., care products, liquid foundations, nail varnishes, lip colorants, creams, oils, and/or hair treatments). The invention also relates to a device for applying, for example, adhesive products, correction fluids, household stain removers, polishes, and/or other products in liquid form or powder form. The invention further relates to systems and methods that include the device for applying a product.

In the field of devices for applying products, there are many devices, such as stain-remover pads, which include a container having a neck and an applicator pad arranged thereon in the form of a foam pad that may be applied to a surface to be treated, for example, the skin or a fabric. The applicator pad may be confined within an upper part of the neck and when loading it with product, it may be necessary to substantially invert the device and press the application surface of the applicator pad against the medium intended to be treated as many as several times in order to "pump" and load the applicator pad with product before applying the product. This method of use may be required because of the need to exert pressure on the applicator pad in order to open a valve which, in the closed position, isolates the applicator pad from the product. In fact, some devices which generally contain volatile formulae often dry out quickly during the period of storage, leading to the formation of a crust on the applicator pad.

For some products, such as polish, the applicator pad is isolated from the product by a valve. This isolation may result in the applicator pad drying out more quickly and rendering the applicator pad unusable, or requiring the user to clean the pad prior to a subsequent use.

Some applicators include a block of foam which may be loaded with a product to be applied. After either wiping the block of foam on the neck of a bottle or through an elastic wiper, the product is applied onto the medium to be treated. The applicator may be generally integral with the cap of the bottle and it may be difficult to adjust the amount of product loaded in the foam block to adjust for, for example, differences between different products to be applied, since the rheologies of the products may vary. The use of such applicators may also be inconvenient, for example, while riding public transportation, because of the independent nature of the applicator pad and the container. This independent nature may, under certain conditions, require the holding the container upright in one hand while applying the product with the other hand.

One example of an applicator is described in European patent application number EP A 0 872 193, commonly assigned, which describes a liquid product application assembly including a product container having a neck defining a free end opening, and a removable structure for hermetically closing the opening. An applicator in the form of a block of foam having either open or semi-open cells and being configured to be loaded with product by pumping, is fitted inside the neck. The applicator includes a first end in permanent liquid communication with the product inside the container, and a second end opposite the first end, with the second end forming an application surface. The application surface can be moved axially between a first position in which the application surface emerges outside the neck through the opening for applying the product, and a second position in which said application surface is contained inside the container. The movement of the application surface from the first position to the second position may be performed by an elastic thrust against a stopper structure, with movement of the application surface from the second position to the first being carried out by removing said stopper structure.

Certain materials used for forming such applicators may tend to deteriorate, for example, when the materials are exposed to the elastic thrust of the stopper structure for a prolonged period. Furthermore, it has been found that it may be desirable to improve the adjustability of the dose of product to be applied, for example, as a function of the rheology of the product so that excessive product flow does not cause excess product to potentially soil the neck of the container.

It may be desirable to provide an elastically compressible support for the applicator that has a greater compressibility than the applicator. Such a construction may render it possible to limit the compression of the applicator during use, dose the rate at which product may be applied, and control the dose for a selected decompression range.

The application device described in European patent application number EP A 1 094 011, commonly assigned, is configured such that the product may be distributed throughout the applicator before reaching the application surface. In this fashion, the applicator can may be loaded with product before the product reaches the application surface. Thus, when the user applies the applicator onto a region to be treated, a relatively large quantity of product tends to flow onto the region to be treated. Furthermore, the product may be urged toward the applicator by pressing flexible walls of the container. Because the user can press continuously on the walls of the container, the product can flow with a relatively high flow rate.

European patent application number EP A 1 125 517 describes an application device in which the applicator is configured to distribute product throughout the applicator before reaching the application surface. The applicator can thus be loaded with product before the product reaches the application surface.

European patent application number EP A 0 155 350 describes a device for application of a perfume or a deodorant that includes a container and an applicator mounted on the container. The applicator is formed from a non-flexible, non-deformable, sintered, porous synthetic resin structure. The product is conveyed from the container via gravity as far as an upper portion of the applicator, for example, by inverting the device. The product is conveyed through a cylindrical wall onto which the applicator abuts axially. The product then arrives at the application surface by flowing through pores of the applicator via capillary action. In this device, the product cannot be held in proximity to the application surface, thereby rendering it necessary to invert the device before each use so that the product flows via gravity through the cylindrical wall.

European patent application number EP A 0 875 465 describes a device for the application of a polish in predetermined doses. This device has a container onto which an applicator is fitted via an intermediate piece that has a wall that may be moved between two positions. The intermediate piece defines a chamber which, in one of the two positions, communicates only with the interior of the container and, in the other of the two positions, communicates only with the applicator. In the first position, the chamber can be filled with product via gravity by inverting the device while the movable wall is held in position by a spring. The user must then hold the device in an inverted orientation and contact the applicator with the region to be polished so as to drive the moveable wall into the second position in order for the product to reach the applicator. The spring returns the moveable wall to its first position via its elasticity when application ceases. Such a device can only be used in an inverted orientation, which may not always be practical, for example, when a product is intended to be applied onto the body, for example, onto a region of the face.

One subject of the invention relates to a device for applying a product that may overcome one or more problems associated with previously-mentioned related art. Another subject of the invention relates to a device that may enable application of a product with a flow rate that is not excessive. Yet another subject of the invention relates to a device in which the product may be conveyed to the applicator in a simple fashion. A further subject of the invention relates to a device that may be simple and/or practical to use.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device for applying a product. The device may include a container configured to contain a product and a duct defining an axis and being associated with the container. The duct may define a passage in one of selective and permanent communication with the container. The device may include an applicator comprising a material permeable to the product. The applicator may define an axial length and include a side wall, a substantially closed first end defining an application surface, and an open second end, wherein the applicator and the container are intended to be coupled together. At least a portion of the axial length of the applicator may be located around the duct. The applicator may be configured such that, when the applicator and the container are coupled together and there is an absence of axial stress exerted on the application surface: a) at least one cavity is formed between a free end of the duct and an internal surface of the applicator facing the free end of the duct; and 2) at least one portion of the applicator lies above the at least one cavity and has a thickness along a direction of the axis of the duct that is less than the thickness of the side wall in a direction substantially perpendicular to the axis of the duct. The device may be configured so that the at least one cavity defines a volume capable of varying.

The "substantially closed first end defining an application surface" refers to an application surface that may be configured such that, when the device is inverted and no axial stress is exerted on the application surface, the product generally does not flow through said application surface to the exterior of the device. Such a configuration may substantially prevent an appreciable amount of product from flowing when not desired so that the risk of accidental soiling is limited. The assembly may be configured in such a manner that it may be stored in an inverted orientation without any leakage of the product.

The term "duct" means, for example, an enclosure, channel, tubular structure (e.g., canal), tube, pipe, or any other structure defining a passage.

According to some exemplary embodiments of the device, the product exiting the container may flow into the cavity, for example, as a result of shaking the device. The product may then flow into the applicator, which may be permeable to the product, and to the application surface. Since the thickness between the cavity and the application surface, as measured along the duct axis, may be less than the thickness of the side wall of the applicator, as measured perpendicularly to the duct axis, the product may reach the application surface before reaching the rest of the external surface of the applicator. This configuration may enable application of the product onto the region to be treated before the side wall of the applicator has become substantially loaded with product, at which point the side wall may be used as a reserve buffer for the product. For example, when the region of the applicator lying between the cavity and the application surface is saturated, the product may flow into the side wall so as to regulate the flow rate of product arriving at the application surface. The presence of the duct may enable the use of a relatively thick applicator (e.g., an applicator having a relatively large axial length), whereas the portion of the applicator lying below the cavity may have a thickness along the duct axis which is less than the thickness of the side wall as measured perpendicularly to the duct axis.

Furthermore, since the cavity may have a volume which can vary, for example, in response to a pressure exerted axially on the application surface, its volume may be reduced when a pressure is exerted on the application surface, for example, when the application surface is applied onto the region to be treated. When the pressure ceases to be exerted, the volume of the cavity may increase (e.g., return to its volume prior to applying pressure) so that some product from the container may be sucked into the cavity. The cavity may hence be filled or refilled each time the application surface is applied onto the region to be treated. In addition, the quantity of product, for example, product from the cavity, which may be applied may hence be dosed by altering the pressure exerted on the application surface.

In another aspect, the second end of the applicator may be configured to be fitted to the container.

In still another aspect, the device may be configured so that the at least one cavity defines a volume capable of varying in response to pressure exerted axially on the application surface.

According to another aspect, the at least one cavity may be configured to retain a portion of the product via capillary action. For example, the dimensions of the cavity may be selected as a function of the viscosity of the product. A reserve of product in the vicinity of the application surface may be obtained.

In still another aspect, the area of the largest cross-section of the at least one cavity may be less than the area of the largest cross-section of the application surface. Since the product may be conveyed to the application surface from the cavity, a portion of product may arrive at the surface of a portion of the application surface substantially equal to the cross-section of the cavity, and hence in a relatively limited region of the application surface. Since the region of the application surface receiving the portion of the product may be relatively limited, the product may be applied in a relatively precise manner.

According to another aspect, the duct may be configured to retain a portion of the product via capillary action. For example, the dimensions of the duct may be selected as a function of the viscosity of the product.

In an additional aspect, the duct may define a side wall including at least one slit extending axially over at least a portion of the duct. The slit(s) may enable the duct to retain a portion of the product via capillary action in the duct. Accordingly, another reserve of product may be formed for supplying the cavity.

According to another aspect, the duct may define a substantially constant internal cross-section. In another aspect, the duct may define an internal cross-section and an axial length, wherein the internal cross-section varies along the axial length of the duct. For example, the internal cross-section of the duct may increase progressively along the axial length in a direction facing away from the cavity. Alternatively, the internal cross-section of the duct may decrease progressively along the axial length in a direction facing away from the cavity.

The duct may have any shape which may enable the product from the container to flow as far as the cavity, for example, after simply shaking the device. For example, the duct may be selected such that its internal cross-section decreases toward the cavity, so as to enable entry of the product coming from the container into the duct and its flow from the container to the cavity. The external cross-section of the duct may be independent of its internal cross-section and it may have any shape, for example, it may have a shape which is somewhat complementary to the internal shape of the applicator.

In an additional aspect, a lateral portion of the side wall of the applicator may contact the duct. Alternatively, the lateral portion of the side wall of the applicator may be spaced from the duct. Such a configuration (e.g., the lateral wall being spaced from the duct) may allow an increase of the capacity of the cavity, for example, with the cavity extending around the duct.

According to another aspect, the device may include an intermediate element including the duct, wherein the applicator and the container are coupled together via mounting the applicator to the intermediate element. The intermediate element may include a single-piece construction. Alternatively, the intermediate element may include a multi-piece construction.

In still another aspect, the container and the duct may be defined by a single piece of material.

In yet another aspect, the intermediate element may include a transverse wall above which a free end of the duct may project, with the transverse wall being one of planar, concave, and convex. For example, the transverse wall may be concave with respect to the interior of the container so as to enable transfer of the product coming from the container toward the cavity.

According to yet another aspect, the intermediate element may define a compartment configured to accommodate the applicator, with the intermediate element defining one of a circular cross-section, an oval-shaped cross-section, a rectangular cross-section, and a polygonal cross-section.

In another aspect, the intermediate element may include a side wall defining an axial length, wherein the side wall of the intermediate element may at least partially hold the applicator on the intermediate element. By selecting the transverse dimensions of the intermediate element in relation to the dimensions of the applicator in such a way that the side wall of the intermediate element exerts a lateral pressure on the side wall of the applicator, the applicator may be held in the intermediate element without additional fastening means being necessary, for example, when the application surface is contacted with a region to be treated.

According to a further aspect, the intermediate element may be fitted onto the container such that it may be moved between at least a first position in which the product flows from the container into the cavity at a first flow rate and a second position in which the product flows from the container into the cavity at a second flow rate. In some aspects, the second flow rate may be zero.

In another aspect, a hollow adaptor may be mounted on the container, with the hollow adaptor including a lateral orifice, wherein the duct is configured to close the lateral orifice when the intermediate element is in the second position.

In still another aspect, the applicator may include at least one passage opening to the application surface, wherein the at least one passage may be configured to have a closed at rest position. The at least one passage of the applicator may include at least one of at least one thin channel and at least one slit. These passage(s) may enable an increase in the dosing capacity and the flow rate of the product. When a plurality of slits is formed, these slits may be arranged in a cross shape or a star shape, although other arrangements are contemplated.

According to another aspect, the applicator may include a substantially rigid material. For example, the applicator may include at least one material selected from frits, frits of polyvinyl chlorides, frits of ethylene vinyl acetates, frits of polyethylenes, frits of polyethylene terephthalates, and frits of polyamides. In some aspects, the applicator may be fitted into the intermediate element, for example, on an elastically compressible structure such as some exemplary ones described in more detail herein.

According to a further aspect, the applicator may at least partially include a flexible, deformable structure. For example, the applicator may at least partially include an elastically compressible material. According to some aspects, the applicator may at least partially include at least one foam selected from closed cell foams, open cell foams, semi-open cell foams, polyurethane foams, polyethylene foams, polyvinyl chloride foams, polyether foams, polyester foams, NBR (acrylonitrile butadiene or nitrile rubber) foams, and SBR (styrene butadiene rubber) foams. In some aspects, the applicator may at least partially include layers of the at least one foam, wherein the layers may be at least one of welded to one another and adhesively secured to one another. In some aspects, the foam(s) may be hydrophilic and they may or may not be cross-linked.

The product may be moved in the applicator via compression and/or decompression of the compressible part of the applicator. Furthermore, compression of the portion of the applicator lying above the cavity may also result in the variation of the volume of the cavity. It may hence be possible to dose the quantity of product to be applied as a function of the compression of the applicator, for example, by altering the pressure exerted on the application surface.

In another aspect, the device may include a removable closure component configured to hermetically enclose the application surface of the applicator. The removable closure component may include one of a screw-fastened cap, a snap-fastened cap, and a hinged lid.

According to another aspect, an internal surface of the applicator may contact a free end of the duct so as to close the passage of the duct in a substantially hermetic fashion when the removable closure component is in a closed position. For example, the removable closure component may include a seal and/or a sealing lip for this purpose and the product may be stored safely inside the device.

In still another aspect, the device may include a removable closure component, wherein the applicator may be at least partially compressed when the removable closure component is in a closed position. For example, the internal surface of the applicator may bear against the free end of the duct so as to close the passage in substantially hermetic fashion when the closure component is in the closed position. The cavity may be substantially reduced or virtually eliminated. The product may be substantially prevented from exiting the duct so that the risk of leakage may be virtually nonexistent when the removable closure component is in the closed position.

When the applicator at least partially includes an elastically compressible material, the compressible part of the applicator may be at least partially compressed when the removable closure member is in the closed position. Thus, after having shaken the device, for example, in order to bring some product into the cavity, the user may open the device, which allows the applicator to expand and may allow the product present in the cavity to be sucked into the applicator, which is permeable to the product, for example, at least at the application surface. The device may hence be primed in a substantially automatic fashion.

In yet another aspect, the application surface may be configured to move axially between a first position in which the application surface extends beyond an opening defined by a free edge of a portion of the device and a second position in which the application surface does not extend beyond the free edge. Thus, when the device is in the closed position, the applicator may be fully accommodated inside the device, so that the overall size of the assembly is reduced. Furthermore, hermetic closure of the device may be relatively simple to obtain with the applicator in such a position.

According to a further aspect, the device may include an elastically compressible element configured to enable the application surface to move between its first position and its second position, wherein the elastically compressible element may have a compressibility which is greater than a compressibility of at least a portion of the applicator. In some aspects that include an applicator at least partially formed from an elastically compressible material, the device may provide a relatively high degree of comfort during use without the applicator being forcefully compressed against the region being treated.

In still another aspect, the elastically compressible element and the applicator are not defined by a single piece of material. For example, when the applicator at least partially includes a rigid material, the elastically compressible element may be separate from the applicator. For example, the elastically compressible element may include at least one block of elastically deformable material (e.g., at least one of at least one block of open cell foam and at least one block of semi-open cell foam). In some aspects, the elastically compressible element may include a spring (e.g., a spring including at least one material selected from metals and plastics).

According to yet another aspect, at least one portion of the applicator may include the elastically compressible element, wherein the elastically compressible element may have a compressibility greater than the compressibility of at least one other portion of the applicator.

According to another aspect, the applicator may include a reinforcement located along at least a portion of the periphery of the applicator, wherein the reinforcement may be configured to provide the difference in compressibility between the applicator and the elastically compressible element. Alternatively, the difference in compressibility between the applicator and the elastically compressible element may result from the presence of a region of the applicator having a smaller cross-section relative to the cross-section of the rest of the applicator.

In still a further aspect, the applicator may be removably coupled to the container via at least one of reversible adhesive bonding, magnetic attraction, and mechanical engagement. For example, the applicator may be fixed to the container via magnetic attraction, for example, by virtue of the presence of a magnetized and/or magnetizable panel configured to interact with a panel of, for example, tin-plate arranged in the container. The applicator may be easily changed, for example, in order to use an applicator which has different characteristics and/or a different application surface, for example, selected as a function of the region to be treated. For example, such a configuration may render it possible to remove the applicator in order to clean and/or reposition it.

According to yet another aspect, the applicator may include one of a circular cross-section, an oval-shaped cross-section, and a polygonal cross-section.

In a further aspect, the applicator may define a cross-section defining at least of one of a concave profile and a convex profile. For example, the applicator may define a cross-section having a dome-shaped profile.

The shape of the application surface may be selected, for example, as a function of the nature of the product to be applied and of the region to be treated. Also, for example, a dome-shaped profile may be selected in order to apply a moisturising cream to the face. The application surface may be covered with, for example, a permeable covering such as a textile, a perforated plastic, a felt, and/or may be covered with flocking which, for example, may include tufts having different diameters, types, lengths, and/or a mixture of such tufts.

According to another aspect, the second end of the applicator may define a cross-section having one of a substantially planar profile, a concave profile, and a convex profile. For example, the profile of the second end may have a shape which is complementary with the shape of the transverse wall of the compartment into which the applicator may be fitted.

In a further aspect, the applicator may include an agent configured to at least one of absorb a fluid and retain a fluid, which may substantially reduce undesirable leakages of product.

In yet another aspect, the applicator may be configured to increase in volume when loaded with product. This may assist with holding the applicator in the intermediate element (e.g., in aspects having an intermediate element).

According to a further aspect, the container may include a body having at least one of at least one rigid wall and at least one semi-rigid wall. For example, the body may include at least one material selected from metals, glasses, thermoplastic materials, polyethylenes, polypropylenes, polyvinyl chlorides, polyethylene terephthalates, and thermosetting materials. In some aspects, the device may be configured to contain a product at about atmospheric pressure. In those aspects, the product may be brought into the cavity via, for example, a simple shake of the device. The product may not be pushed into the cavity under substantial pressure so that an excessive flow rate of the product may be avoided. Furthermore, in those aspects, the applicator is not necessarily fixed irreversibly to the container.

In an additional aspect, the device may include at least one mobile element contained in the container, wherein the at least one mobile element may be configured to promote at least one of homogenization of the product and flow of the product through the passage. For example, the at least one mobile element may include at least one of at least one ball and at least one weight.

In a further aspect, the device may include a structure configured to prevent the at least one mobile element from closing the passage. For example, the structure may include at least one of at least one bead and at least one fin arranged around the passage.

In still another aspect, the container may be in the form of a tube and may include at least one side wall, wherein the applicator extends away from the at least one side wall of the container.

According to yet another aspect, a system for applying a product may include a device for applying a product, and a product contained in the container. For example, the product may include a cosmetic product, for example, one of a nail varnish, a liquid lip colorant, a cream, a lotion, an oil, a powder, a make-up remover, a nail product remover, a liquid foundation, a coloring composition, a bleaching composition, a permer, or any other type of nail, skin, and/or hair product. Alternatively, the product may include one of an adhesive, a correction fluid, a stain remover, and a polish.

In another aspect, the product contained in the container may be at substantially atmospheric pressure.

In still another aspect of the invention, a method of applying a product may include providing a system for applying a product, causing at least a portion of the product to be conveyed from an interior of the container to the cavity, and contacting the application surface to a region so as to apply the product to the region. For example, causing at least a portion of the product to be conveyed to the cavity may include shaking the system. The product may include a cosmetic product, and the method may include varying the rate of product transferred onto the region as, for example, a function of the pressure exerted on the application surface.

The term "providing" is used in a broad sense, and refers to, but is not limited to, making available for use, manufacturing, enabling usage, giving, supplying, obtaining, getting a hold of, acquiring, purchasing, selling, distributing, possessing, making ready for use, forming and/or obtaining intermediate product(s), and/or placing in a position ready for use.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is an exploded perspective view of an embodiment of a device for applying a product;

Figure 6:
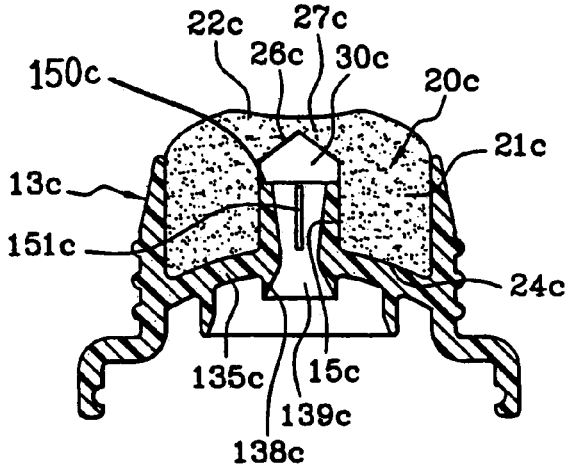
FIG. 6 is a schematic section view of a portion of another embodiment of a device for applying a product.
Figure 6A:
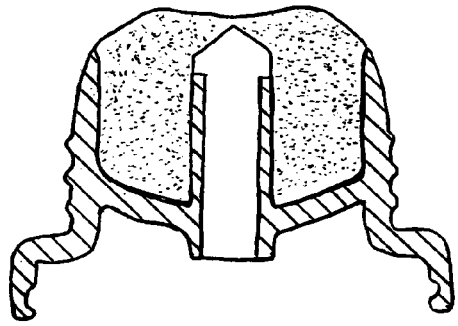
Figure 7:
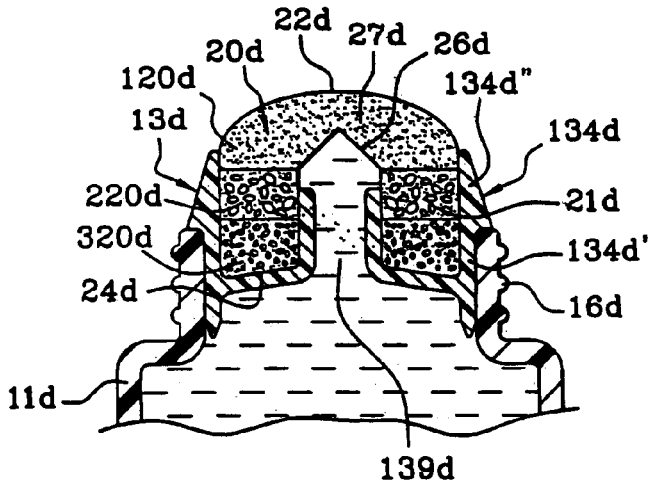
Figure 8A:
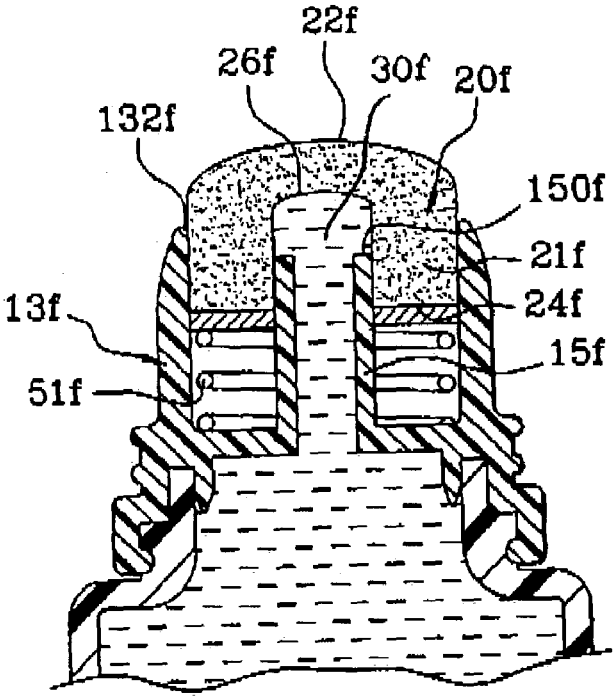
Figure 8B:
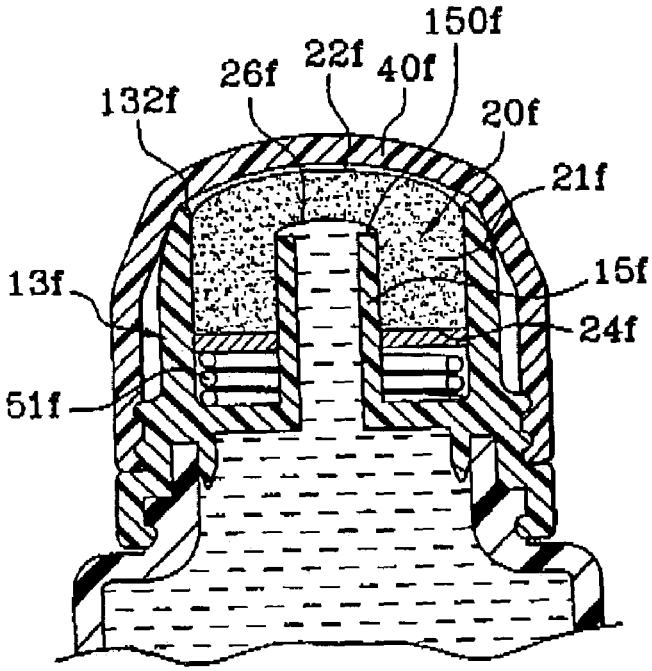
Figure 9:
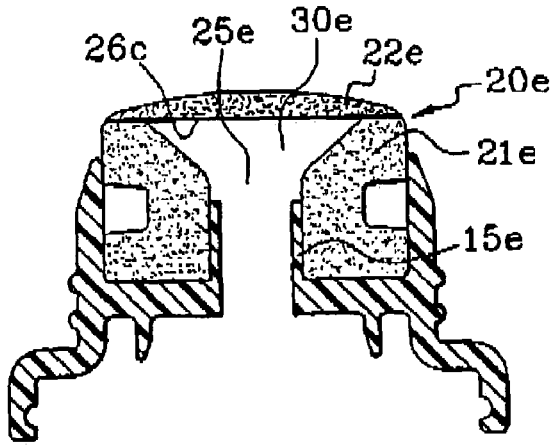
Figure 10:
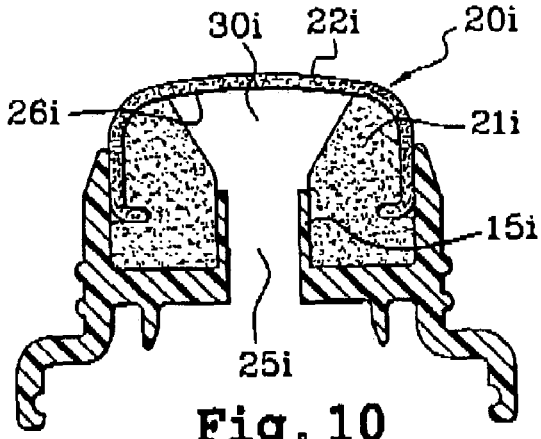
Figure 11:
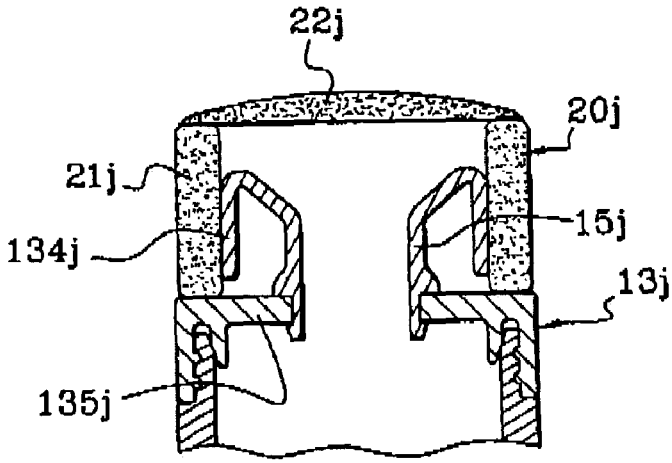
Figure 12:
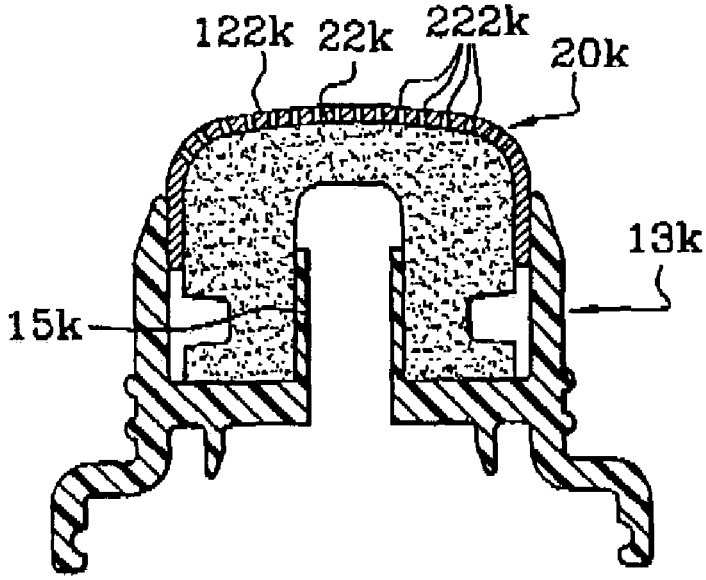
Figure 13:
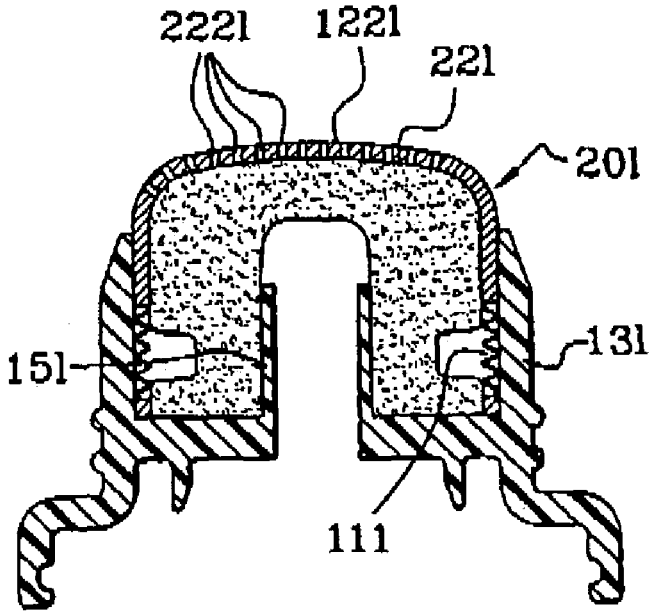
Figure 14A:
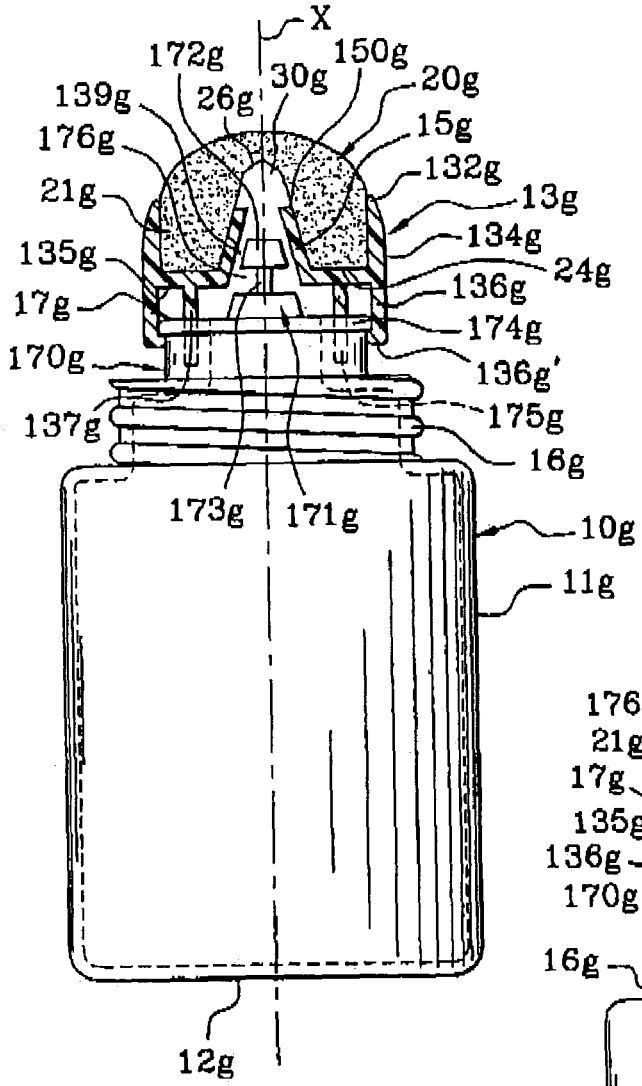
Figure 14B:
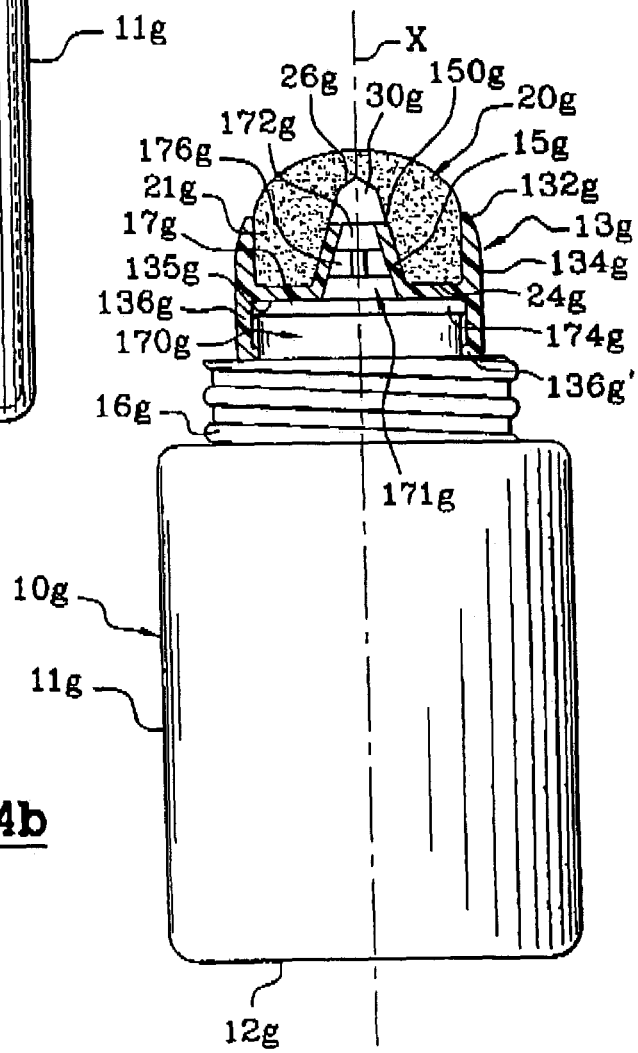
Figure 15:
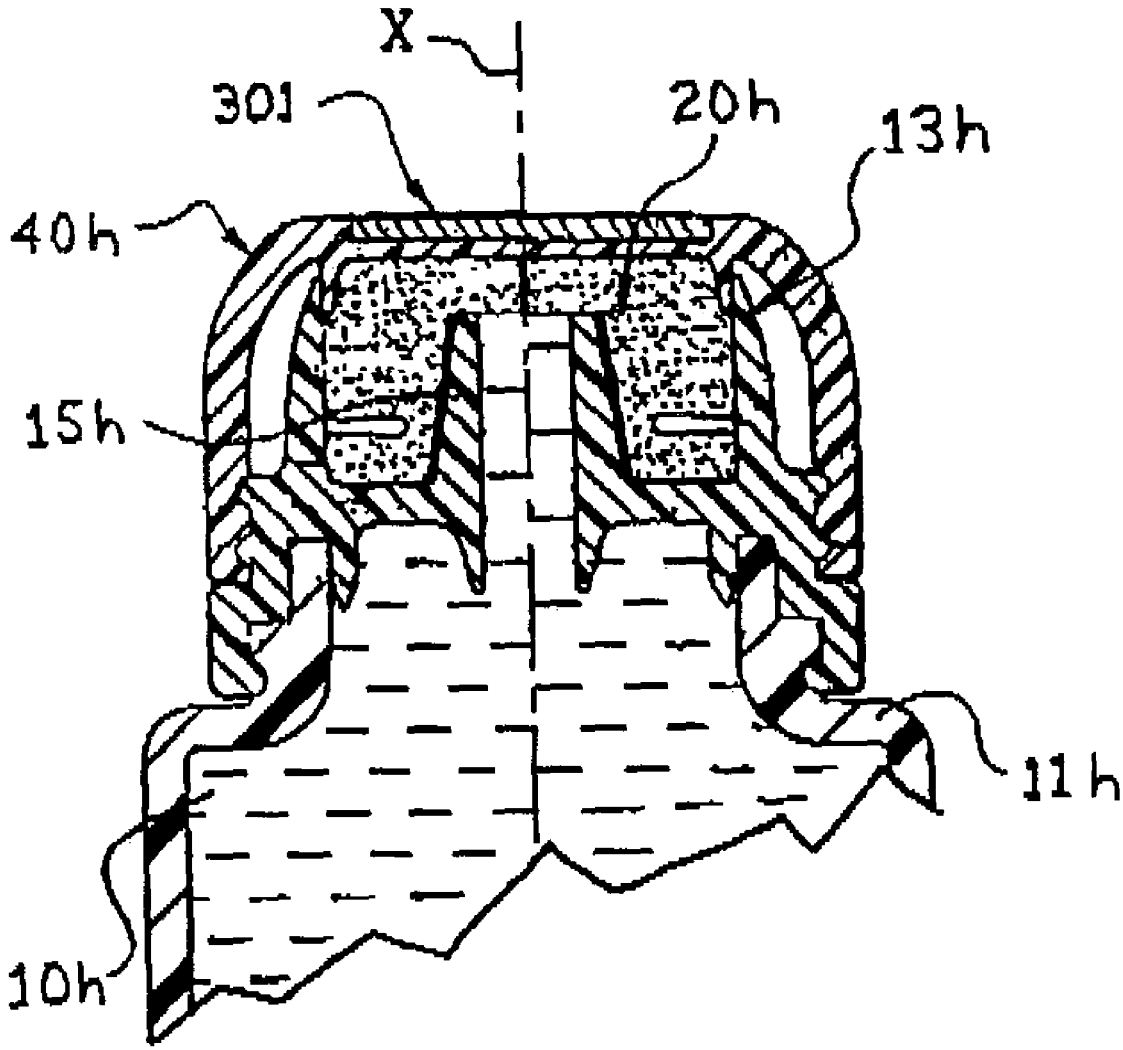
Figure 16:
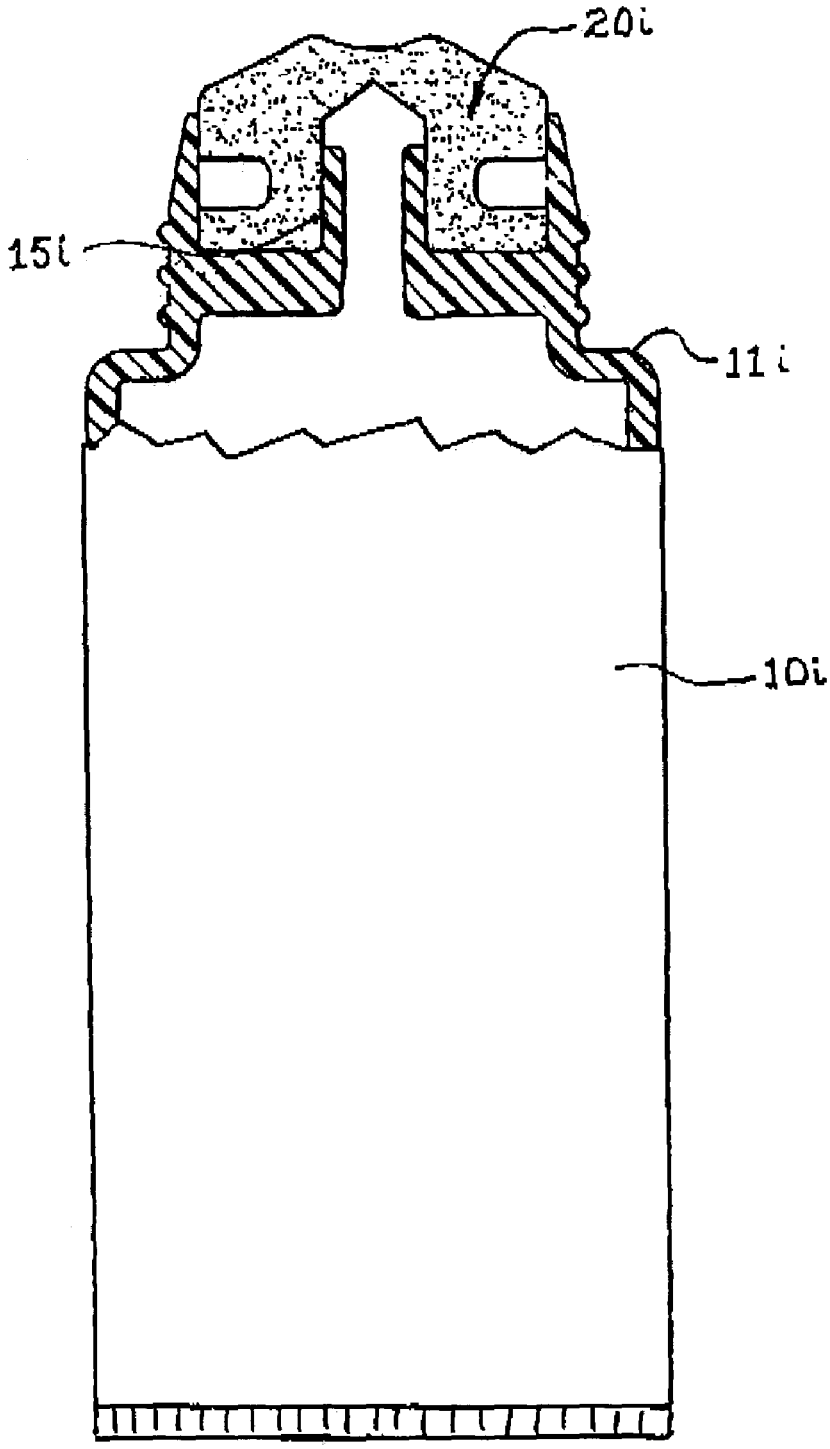
Figure 17:
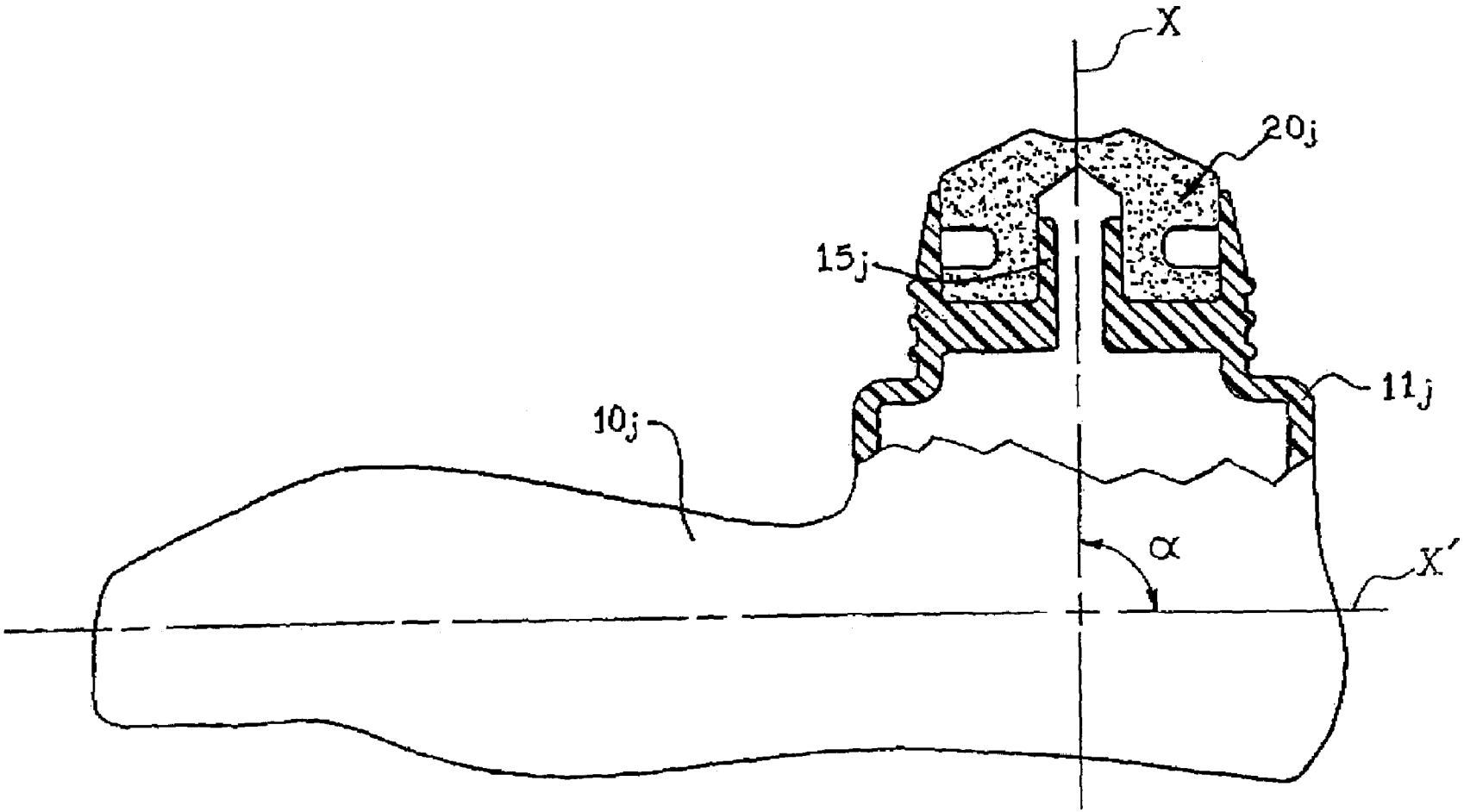

FIG. 6*a* is a schematic section view of a portion of yet another embodiment of a device for applying a product;

FIG. 7 is a partial schematic section view of a further embodiment of a device for applying a product;

FIG. 8*a* is a partial schematic section view of another embodiment of a device for applying a product in a first state;

FIG. 8*b* is a partial schematic section view of the embodiment of the device for applying a product depicted in FIG. 8*a* in a second state;

FIG. 9 is a schematic section view of another embodiment of a portion of a device for applying a product;

FIG. 10 is a schematic section view of a further embodiment of a portion of a device for applying a product;

FIG. 11 is a schematic section view of another embodiment of a portion of a device for applying a product;

FIG. 12 is a schematic section view of a further embodiment of a portion of a device for applying a product;

FIG. 13 is a schematic section view of another embodiment of a portion of a device for applying a product;

FIG. 14*a* is a partial schematic section view of a further embodiment of a device for applying a product in a first state;

FIG. 14*b* is a partial schematic section view of the embodiment of a device for applying a product depicted in FIG. 14*a* in a second state;

FIG. 15 is a partial, cut-away schematic section view of another embodiment of a device for applying a product;

FIG. 16 is a cut-away, schematic section view of a further embodiment of a device for applying a product; and FIG. 17 is a cut-away, schematic section view of another embodiment of a device for applying a product.

Reference will now be made in detail to some possible embodiments of the invention, examples of which are illustrated in the accompanying drawings. Wherever possible, the same reference numbers are used in the drawings and the description to refer to the same or like parts.

Figure 1:
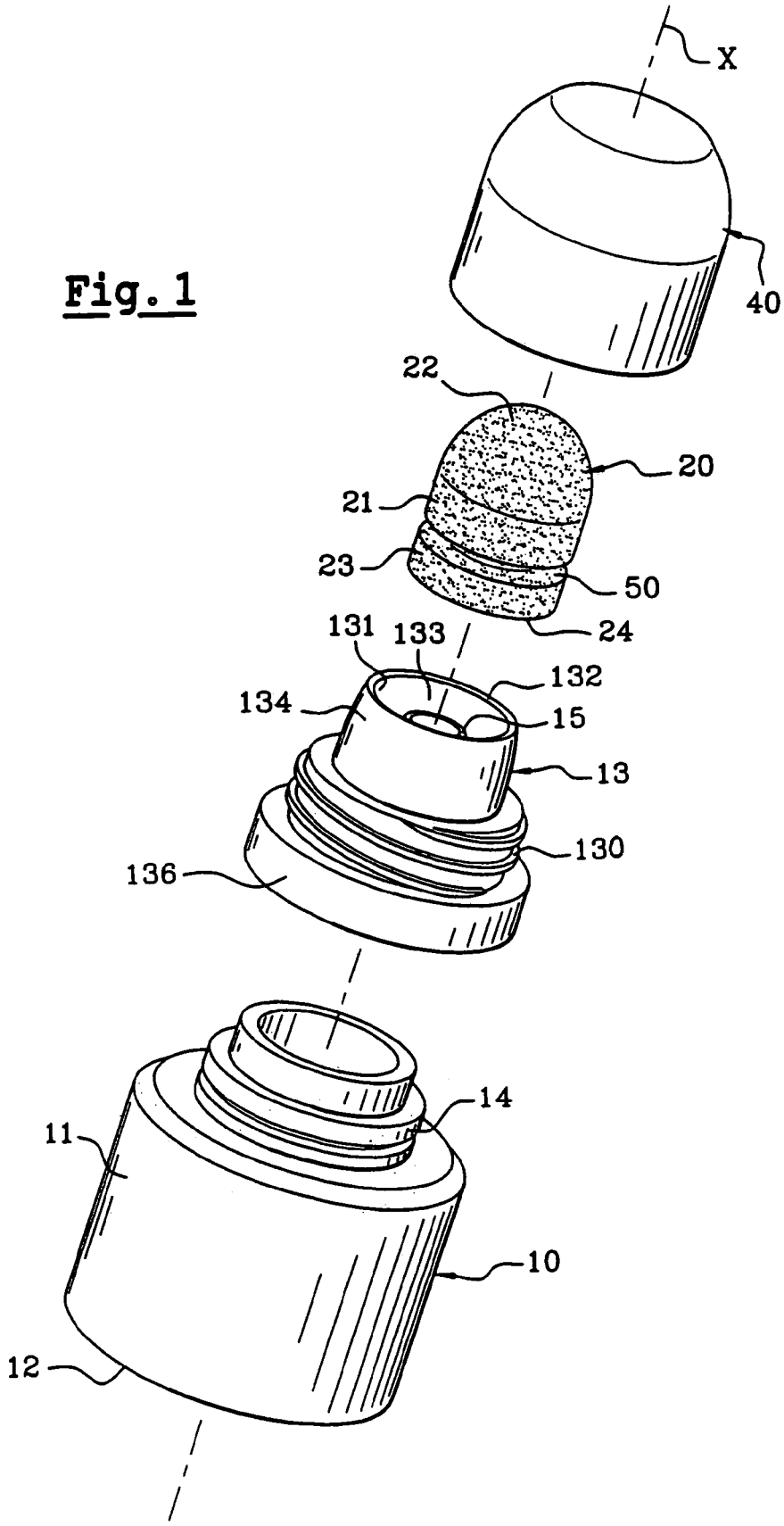
Figure 2:
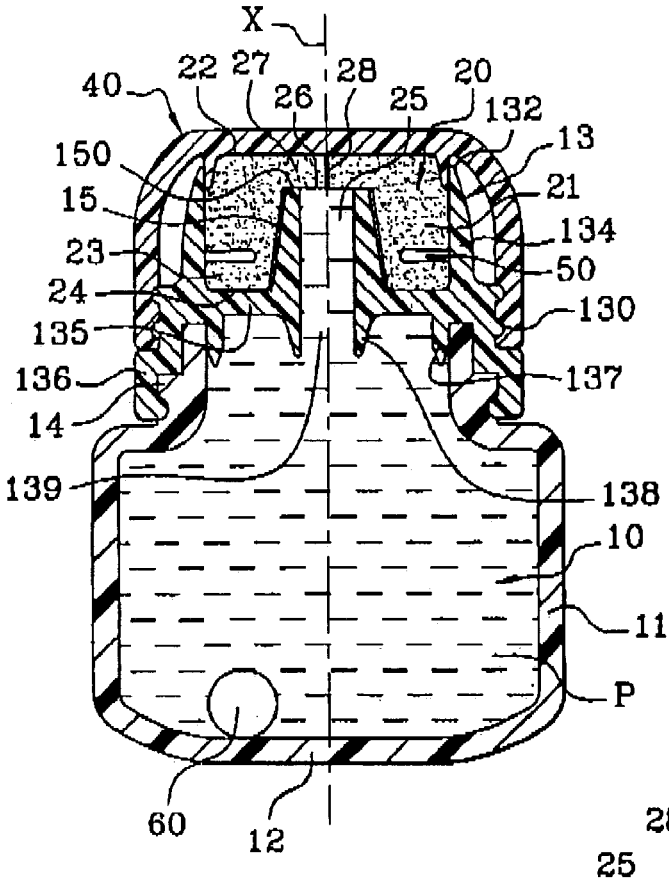
FIG. 2 is a schematic section view of the embodiment of the device depicted in FIG. 1 in a first state.
Figure 3:
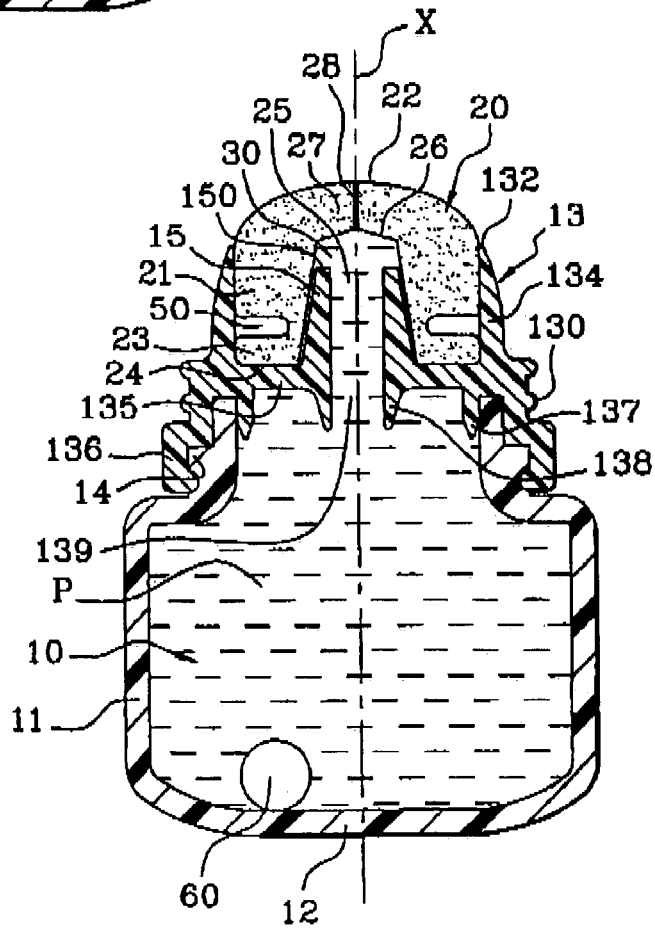
FIG. 3 is a schematic section view of the embodiment of the device depicted in FIG. 1 in a second state.

FIGS. 1 through 3 depict an exemplary embodiment of a device for applying a product that may include an applicator bottle for a product P, for example, a liquid cream and/or liquid foundation. The device may include a container 10 having a body 11, one end of which may be closed by a base 12. An application head may be mounted on the other end of the container (e.g., at a neck of the container 10). The application head may include an intermediate element 13 configured to fit the application head onto the container 10. An application component 20 may be accommodated in the intermediate element 13. On its external surface, the intermediate element 13 may include a structure 130, for example, a screw thread and/or a snap-fastening structure, configured to allow removable fitting of a cap 40 that may be configured to hermetically close an opening 131 delimited by a free edge 132 of the intermediate element 13. A mobile element 60 (e.g., a ball and/or weight) may be located inside the container 10 (e.g., for facilitating homogenizing of the product during shaking of the device and/or for facilitating its flow).

The internal wall of the intermediate element 13 may define a compartment 133 (e.g., a cylindrical internal compartment), which may be axisymmetric around an axis X. The compartment 133 may have a side wall 134 and a transverse wall 135 (e.g., a substantially planar transverse wall) constituting the base of the compartment 133. A mounting flange 136 may extend the side wall 134 beyond the transverse wall 135, on the opposite side from the opening 131 of the intermediate element 13. The mounting flange 136 may be fixed via, for example, snap-fastening onto the body 11 of the container 10 at a radial projection 14 that may be provided on the opposite side from the base 12 of the container 10. The snap-fastening system may be replaced by other fastening systems such as, for example, a screw-fastening system. A sealing flange 137 may be provided on the transverse wall 135 of the compartment 133 in order to come into hermetic contact with the interior of the container 10. The body 11 of the container 10, the intermediate element 13, as well as the cap 40 may be made of rigid material, for example, polyethylene. Alternatively, at least one of the body 11 of the container 10, the intermediate element 13, and the cap 40 may be made of a different material.

The compartment 133 may communicate with the interior of the container 10 via a passage 139, which may be provided in a duct 15 extending, for example, along the axis of the internal compartment 133. The duct 15 defines an axis, may be formed integrally with the transverse wall 135, and may extend therefrom to a free end 150 lying inside the compartment 133. The duct 15 may have a circular internal cross-section that may be constant over substantially the entire length of the duct 15, and the external cross-section of the duct 15 may decrease, for example, toward the free end 150. The diameter of the duct 15 may be selected as a function of the product P contained in the container 10, so that the product P coming from the container 10 can flow into the duct 15 as a result, for example, of a simple shake of the device. The diameter of the duct 15 may be selected so that the product P which has entered the duct 15 can be held via capillary action inside the duct 15. Fins 138 may be included on the transverse wall 135 of the compartment 133, for example, around the entry of the duct 15 on the same side as the container 10, in order to prevent the mobile element 60 arranged in the container from substantially obstructing the duct 15.

An applicator in the form of an application component 20 may be fitted inside the compartment 133, for example, around the duct 15. The application component 20 may be in the form of, for example, a block of porous material, at least a part of which may be elastically compressible. In some exemplary embodiments, the application component 20 may comprise a block of foam having open cells, for example, a block of polyurethane foam. In some exemplary embodiments, the application component 20 may comprise an axial sequence of at least two portions of foam having different compressibility characteristics which may be secured to each other. The application component 20 may contain an agent configured to absorb and/or retain water.

According to some exemplary embodiments, the application component 20 may have a substantially cylindrical shape, for example, and a circular cross-section, although the application component 20 may have other shapes, for example, a frustoconical or prismatic shape, and an oval, rectangular, or polygonal-shaped cross-section.

The application component 20 may include a side wall 21, and may include one end 22 which comprises an application surface in the form of, for example, a dome. The application surface 22 may be covered with a permeable covering such as, for example, a textile, a perforated plastic, a felt, and/or a flocking. The flocking may comprise, for example, tufts having different diameters, and/or different types, and/or different heights, and mixtures thereof. On the side opposite to the application surface 22, the application component 20 may have a second end 24 that may be open and which may contact with the transverse wall 135 of the compartment 133. The second end 24 may, for example, be fixed permanently to the intermediate element 13. The second end 24 may be removably fixed, so that the application component 20 may be more easily removed in order, for example, to clean it. The second end 24 of the application component 20 may be covered with a permanent adhesive, for example, an acrylic adhesive, which may adhere more securely to the application component 20 than to the transverse wall 135.

A portion 23 of the side wall 21 lying in the vicinity of the second end 24, may be configured to support the application component 20. The portion 23 may be separated from the rest of the application component 20 by an annular groove 50 which defines a region having a relatively smaller cross-section. The annular groove 50 may allow the region with smaller cross-section to have a greater compressibility than the rest of the application component 20. Hence, when a pressure is exerted on the application component 20, the maximum compression of the region with smaller cross-section may occur before the maximum compression of the application component 20.

When the application component 20 is fitted into the compartment 133, the application component 20 may substantially occupy the compartment 133, and the application component 20 may have a shape which is substantially complementary with the shape of the compartment 133. The application component 20 may have, for example, an axial recess 25 whose shape may be selected so that the application component 20 contacts the wall of the duct 15 without being substantially compressed laterally by the duct 15. In some exemplary embodiments, the wall of the application component 20 may be spaced from the duct 15. When the application component 20 is in the expanded position, for example, the axial recess. 25 may have an axial length which is substantially larger than the axial length of the duct 15 so as to define an internal cavity 30 inside the application component 20 between an internal surface 26 lying in front of the duct 15 and the free end 150 of the duct 15. A portion 27 of the application component 20 above the cavity 30 may have an axial thickness as measured in a direction along the axis X which is smaller than the thickness of the side edge 21 of the application component 20 as measured perpendicularly to the axis X. The cavity 30 may serve as a reserve of product P in proximity to the application surface 22, with the product P being capable of contacting the application component 20 only in the cavity 30. Furthermore, the area of the cross-section of the cavity 30 may be less than the area of the cross-section of the application surface 22. The product P may therefore arrive at the level of the application surface 22 in a relatively limited region, which may allow a more precise application of the product P. In order to increase the distribution flow rate of the product P toward the application surface 22, a slit 28 (e.g., an axial slit) may be located in the application component 20, for example, along the axis X, from the cavity 30 to the application surface 22. The width of this slit may be selected as a function, for example, of the viscosity of the product P and a desired flow rate.

The application component 20 may have a diameter ranging from about 2 millimeters to about 80 millimeters, for example, from about 5 millimeters to about 25 millimeters. The application component 20 may have a height, for example, in a substantially uncompressed condition, ranging from about 1.5 millimeters to about 50 millimeters. The duct 15 have an axial height, for example, ranging from about 1 millimeter to about 48 millimeters, and a diameter ranging from about 2 millimeters to about 30 millimeters, for example. The cavity 30 may have a diameter, for example, substantially equal to diameter of the duct 15, and a height, for example, ranging from about 1 millimeter to about 30 millimeters.

The application component 20 may include pores and/or open cells, for example, having an average size ranging from about 0.5 micrometer to about 3 millimeters. The pores and/or open cells may communicate with one another in an omni-directional fashion.

FIG. 2 depicts the exemplary embodiment of FIG. 1 having a cap 40 in the closed position (e.g., storage position). The application component 20 may be partially compressed, so that the cavity 30 is substantially eliminated. The internal wall 26 of the application component 20 may contact the free end 150 of the duct 15. In this configuration, the product P coming from the container 10 may not emerge from the duct 15 through the end 150 due, for example, to the presence of a compressed portion of the application component 20. A region of the application component 20 having a smaller cross-section, for example, lying level with the groove 50, may also be compressed. The application surface 22 may lie substantially (e.g., entirely) inside the intermediate element 13.

FIG. 3 depicts the exemplary embodiment of FIGS. 1 and 2 with cap 40 removed. Upon removal of the cap 40, for example, the application component 20 may expand and cause formation of the cavity 30 and suction of the product P into the cavity, for example, when a portion of the product P is in the duct 15. When the cap 40 is removed, the product P may be conveyed into the cells of the foam which lie in proximity to the cavity 30. After removing the cap 40, the application component 20 may no longer be compressed. The application surface 22 may then emerge from the intermediate element 13 above the free edge defining the opening 131. The application surface 22 may then be in a position of use.

Some exemplary embodiments of the device for applying a product may be used by, for example, shaking, the device in order to bring a portion of the product P into the duct 15. Some of the portion of product P may then be retained via capillary action inside the duct 15. A user may then remove the cap 40, which may result in decompression of the application component 20 and the region of the application component 20 lying substantially level with the groove 50, for example, such that the application surface 22 emerges from the intermediate element 13. The height of the application component 20 may increase less than the height of the region of the application component 20 lying level with the groove 50. The decompression of the application component 20 may be accompanied by formation of the cavity 30. This may result in suction of at least a portion of the product P into the cavity 30 and, for example, pumping of the product P into cells of the foam which lie in proximity to the cavity 30. The portion 27 of the application component 20 lying between the cavity 30 and the application surface 22 may then become substantially loaded with product P, whereas the side wall 21 of the application component 20 may not become substantially loaded with product P. The side wall 21 may serve as a reserve buffer for the product P. For example, in the event that, when the cap 40 is opened, the portion 27 of the application component 20 lying, between the cavity 30 and the application surface 22 is not substantially entirely saturated, it may then be sufficient, for example, to slightly compress the application component 20 by applying the application surface 22 onto the region to be treated, and then to relax the pressure so as to expand the application component 20 in order, during this expansion, for the product P present in the cavity 30 to be pumped by cells of the foam toward the application surface 22.

Applying a dose of product P according to some exemplary embodiments onto a region to be treated may include contacting the application surface 22 to the region and exerting a pressure on the application component 20 as a function of a desired dose of product P. The application of pressure may result in partial compression of the application component 20 and ejection of a dose of product P. The volume of the cavity 30 may be reduced during this compression. Application of excessive pressure may cause ejection of excess product P, with the risk of causing soiling. This soiling may be compensated, at least to some extent, by the presence of the groove 50. For example, the region of the application component 20 having a relatively reduced cross-section (e.g., the region lying level with the groove 50) may limit the amount of compression of the remaining portions of the application component 20 due its compression.

After the pressure exerted on the application component 20 has been relaxed, a portion of the product P may be applied to the region to be treated via the application surface 22. Relaxation of the pressure of the application component 20 against the region, for example, the skin, may be accompanied by suction of at least a portion of the product P contained in the cavity 30 into the cells of the application component 20, and may result in an increase in the volume of the cavity 30 and filling of the cavity 30 via suction of at least a portion of the product P present in the duct 15. This may result in the application component 20 being quickly reloaded for another application. For example, the product P may be applied by contacting the application surface 22 against the region to be treated by simple capillary contact so as to distribute the product P in the form of a film, for example, via the affinity of the product P being exerted between the application surface 22 and the region to be treated, without exerting substantial pressure on the application component 20.

According to some exemplary embodiments (not shown), the application component 20 may be configured so that, when the cap 40 is in the closed position, the volume of the cavity 30 is not completely eliminated. For example, the volume of the cavity 30 may be merely reduced relative to the volume of the cavity 30 when the application component 20 is in an expanded condition.

Figure 4:
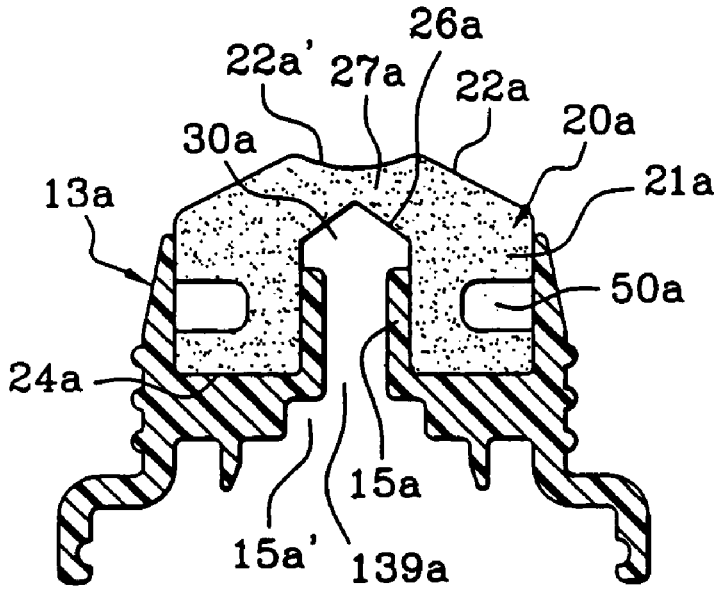
FIG. 4 is a schematic section view of an embodiment of a portion of a device for applying a product.

FIG. 4 depicts an exemplary embodiment of an application component 20*a* that may be suitable for substitution with the application component 20, for example, shown in FIGS. 1 through 3. The application component 20*a* may include an application surface 22*a* whose overall shape is convex and a small concave portion 22*a'*. Exemplary embodiments having this configuration may result in the application component 20*a* having a relatively reduced thickness 27*a* (e.g., of foam material) between the application surface 22*a'* and the cavity 30*a*.

The exemplary embodiment of FIG. 4 depicts an intermediate element 13*a*, for example, including a duct 15*a* having an internal cross-section that is not constant over its entire length. For example, the duct 15*a* includes a first diameter at a portion of the duct 15*a* in the vicinity of the container (not shown in FIG. 4), a shoulder 15*a'*, and a second diameter that may remain constant to the free end of the duct 15*a* beyond the shoulder 15*a'*. The internal cross-section of the duct 15*a* is greater over a portion of its axial length in the vicinity of the container 10 than over the rest of its length. Such a duct configuration may enable the product P to more easily enter the duct 15*a* because of its larger cross-section in the vicinity of the container 10.

Figure 5:
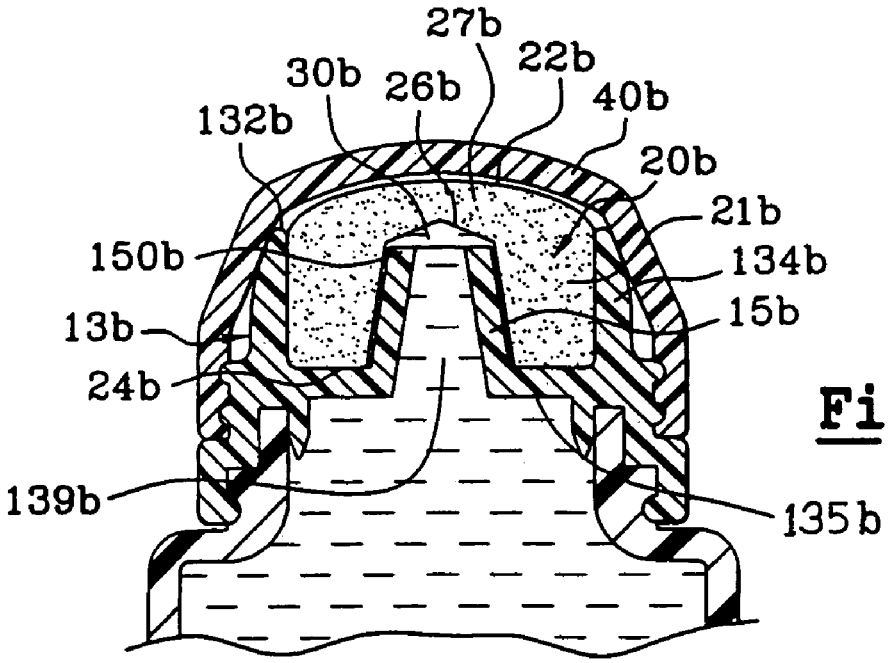
FIG. 5 is a partial schematic section view of a further embodiment of a device for applying a product.

FIG. 5 depicts an exemplary embodiment of an application component 20*b* that may not include any additional elastically compressible means. For example, when the cap 40*b* is in the closed position, the application component 20*b* may not be substantially compressed, the application surface 22*b* may protrude beyond the free edge 132*b* of the intermediate element 13*b*, and a cavity 30*b* may be formed between the free end 150*b* of the duct 15*b* and the internal surface 26*b*. The application component 20*b* may be held in the compartment solely as a result of, for example, lateral pressure exerted by the side wall 134*b* of the compartment on the side wall 21*b* of the application component 20*b*.

In the exemplary configuration shown in FIG. 5, when the device for applying product is shaken, for example, regardless of whether or not the cap 40*b* is closed, some product P may be brought into the cavity 30*b* via the duct 15*b*, and may be retained therein via capillary action. A user may then contact the application surface 22*b* with the region to be treated, for example, while compressing a portion of the application component 20*b* lying between the application surface 22*b* and the cavity 30*b*. The product P present in the cavity 30*b* may then be pumped into the cells of the application component 20*b* and brought to the application surface 22*b*.

The exemplary embodiment shown in FIG. 5 includes a duct 15*b* that may have an internal cross-section that decreases, for example, progressively from the transverse wall 135*b* to the free end 150*b* of the duct 15*b*. This exemplary configuration of the duct 15*b* may promote flow of the product P from the container 10 (not shown in FIG. 5) toward the cavity 30*b*.

The exemplary embodiment of a device for applying a product depicted in FIG. 6 may include a duct 15*c* that may have an internal cross-section that increases (e.g., progressively) from the transverse wall 135*c* to the end 150*c* of the duct 15*c*. The side wall of the duct 15*c* may include at least one axial slit 151*c*, for example, extending over a portion of the length of the duct 15*c*. The slit 151*c* may render it possible, for example, to retain a portion of the product P in the duct 15*c* via capillary action. The transverse wall 135*c* may either be concave with respect to the interior of the container 10 as shown in FIG. 6) so as to enable flow of the product P in the duct 15*c*, or convex with respect to the interior of the container 10 (as shown in FIG. 6*a*).

The exemplary embodiment of the application component 20*c* shown in FIG. 6 may include an application surface 22*c* that is at least slightly concave and that may have an end 24*c* opposite the application surface 22*c* that has a profile that is concave with respect to the interior of the container 10, for example, in order to match the profile of the transverse wall 135*c*.

The exemplary embodiment shown in FIG. 7 may include an intermediate element 13*d* and three blocks 120*d*, 220*d*, and 320*d* (e.g., a stack blocks) of foams, for example, foams of a different types that may be fixed to each other. The body 11*d* of the container may include screw thread 16*d* on its external surface, for example, in order to enable removable fitting of a cap (not shown), for example, similar to the cap 40. The side wall 134*d* of the intermediate element 13*d* may include a portion 134*d'* that is accommodated inside the container while being in substantially hermetic contact with the interior wall of the container, and a second portion 134*d"* that may contact a free edge of the container.

FIGS. 8*a* and 8*b* depict an exemplary embodiment of a device that may include an application component 20*f* comprising, for example, a rigid and porous material (e.g., a polyethylene frit) that may be received in the intermediate element 13*f* along with a reinforcement 24*f*, for example, conficjured to provide a difference in compressibility, and a spring 51*f*. FIG. 8*a* depicts the exemplary device in an open condition (i.e., without a cap mounted on the device). In the open condition, the spring 51*f* may be in an expanded condition and the application surface 22*f* may emerge outside the intermediate element 13*f*, for example, above the free edge 132*f* defining the opening of the intermediate element 13*f*. A cavity 30*f* may be formed between the free end 150*f* of the duct 15*f* and the internal surface 26*f* of the application component 20*f*. FIG. 8*b* depicts the exemplary device in the storage position (i.e., with a cap 40*f* mounted on the device). The spring 51*f* may be in a compressed condition and the application surface 22*f* may lie at least almost entirely inside the intermediate element 13*f*. The internal wall 26*f* of the application component 20*f* may contact the free end 150*f* of the duct 15*f*, thereby substantially eliminating, for example, the volume of the cavity 30*f*.

According to this exemplary embodiment, the product P may be brought into the duct 15*f* and into the cavity 30*f* by shaking the device. The product P may then be conveyed to the application surface 22*f*, for example, via pores in the application component 20*f*. After arriving at the application surface 22*f*, the product P may be conveyed out of the application surface 22*f*, for example, only when the application surface 22*f* is contacted with a surface (e.g., the surface to be treated).

The exemplary embodiment depicted in FIG. 9 may include an application component 20*e* including side walls 21*e* comprising a first block of material (e.g., foam material). This block of material may have, for example, open cells and/or closed cells. The application surface 22*e* of the upper end of the application component 20*e* may include of a block of material (e.g., foam material, such as, for example, open-cell foam material) configured to form a tip that may be secured (e.g., via welding and or adhesive) onto the portion 21*e*. The application component 20*e* may have an axial recess 25*e* including, for example, a cylindrical portion, in which a duct 15*e* may be located, and a frusto-conical portion that increases in cross-section from the cylindrical portion to the internal surface 26*e* of the application surface 22*e*, so as to define the cavity 30*e*. This exemplary embodiment may be used, for example, to apply a cosmetic product in powder form.

The exemplary embodiment of an application component 20*i* depicted in FIG. 10 may include an upper end 22*i* comprising a sheet of non-woven and/or woven fabric that may be inserted around the side wall 21*i*.

FIG. 11 depicts an exemplary embodiment of a device that may include an intermediate element 13*j* that may comprise two or more pieces. The duct 15*j* may be secured, for example, via engagement, to the transverse wall 135*j*. The duct 15*j* may also be secured to an axial flange 134*j* around which the application component 20*j* may be positioned. The application component 20*j* may include a side wall 21*j* formed, for example, by a hollow cylindrical block of material (e.g., foam material) and by an upper end 22*j*, which may comprise a tip secured to the side wall 21*j* (e.g., via welding and/or adhesive).

FIGS. 12 and 13 depict exemplary embodiments of an application component 20*k* and 20*l*, respectively, that may include application surfaces 22*k* and 22*l* covered by a sheath 122*k* and 122*l* of, for example, rigid plastic and/or an elastomer, which may include a plurality of orifices 222*k* and 222*l* (e.g., for allowing the product P to flow therefrom). In the exemplary embodiment depicted in FIG. 12, the sheath 122*k* may be secured to application component 20*k* so that the sheath 122*k* can slide in the intermediate element 13*k*, for example, when the application component is compressed. In the exemplary embodiment depicted in FIG. 13, the sheath 122*l* may be secured to the intermediate element 131 and may include a bellows portion 111, for example, allowing the sheath 122*l* to deform when the block of material (e.g., foam material) of the application component 20*l* is compressed.

FIGS. 14*a* and 14*b* depict an exemplary embodiment of a device that may render it possible to vary the rate at which the product P is conveyed (e.g., flows) into the cavity 30*g*. The device may include a container 10*g* having a body 11*g* which defines an axis X, one end of which may be closed by a base 12*g*. An application head may be mounted on the end opposite the base 12*g* of the container 10*g*. The application head may be formed by an intermediate element 13*g*, in which an application component 20*g* is accommodated. The intermediate element 13*g* may be mounted on the body 11*g* of the container 10*g* such that the intermediate element 13*g* can slide. The body 11*g* of the container 10*g* may include a screw thread 16*g*, for example, immediately below the intermediate element 13*g*, to allow a cap (not shown) to be removably mounted such that an opening defined by the free edge 132*g* of the intermediate element 13*g* may be hermetically closed.

An adaptor 17*g* may be, for example, irreversibly secured into the body 11*g* of the container 10*g* along the axis X. The adaptor 17*g* may be a hollow body that communicates with the interior of the container 10*g*. The adapter 17*g* may include a first portion 170*g* having, for example, a substantially cylindrical shape, on which the intermediate element 13*g* may slide. The adaptor 17*g* may include second portion 171*g* (e.g., a frustoconical portion) which decreases in cross-section from the cylindrical portion 170*g* to a closed end 172*g*. At least one lateral orifice 176*g* may be formed in the second portion 171*g* of the adaptor 17*g* in the vicinity of the end 172*g*. The end 172*g* may be connected to the rest of the second portion 171*g* by a stub 173*g* formed along the axis X of the container 10*g*. The stub 173*g* may be secured to the second portion 171*g* via fins (not shown) which may be formed in a plane substantially perpendicular to the axis X. The first portion 170*g* and the second portion 171*g* of the adaptor 17*g* may be connected via an annular, transverse wall 174*g* having a diameter that may be slightly greater than the diameter of the first portion 170*g* (e.g., when the first portion is cylindrical) so as to form an annular, radial projection. The transverse wall 174*g* may include an annular groove 175*g* around the base of the second portion 171*g*.

The internal wall of the intermediate element 13*g* may define an internal compartment (e.g. a cylindrical compartment) that may be axisymmetric about the axis X. The application component 20*g* may be fitted in the internal compartment and the application component 20*g* may include a cavity 30*g* at least similar to the exemplary cavity 30*b* depicted in FIG. 5. The internal compartment may include a side wall 134*g* and a substantially planar transverse wall 135*g* that substantially defines a base of the internal compartment. A mounting flange 136*g* may extend the side wall 134*g* beyond the transverse wall 135*g* on the opposite side-of the intermediate element 13*g* from the opening substantially defined by the free edge 132*g*. The mounting flange 136*g* may terminate in a projection 136*g'* (e.g., a radially extending projection) that extends toward the interior of the container 10*g*. The projection 136*g'* may be secured onto the body 11*g* of the container 10*g* so as to slide on the first portion 170*g* of the adaptor 17*f*. In one position (e.g., at one end of travel), the projection 136*g'* may contact the annular projection formed by the periphery of the transverse wall 174*g*. A sealing flange 137*g* may be provided on the transverse wall 135*g* of the internal compartment. The sealing flange 137*g* may interact with an annular groove 175*g* located in the transverse wall 174*g* of the adaptor 17*g* such that the sealing flange 137*g* slides in a substantially hermetic fashion.

A duct 15*g* may be formed integrally with the transverse wall 135*g*, may extend along the axis X to the compartment, and may open into the cavity 30*g* of the application component. The duct 15*g* may, for example, have a frustoconical shape, which may be complementary with the frustoconical portion 171*g* of the adaptor 17*g*.

In a first position (e.g., the position depicted in FIG. 14*b*), the duct 15*g* may contact in a substantially hermetic fashion on the second portion 171*g* of the adaptor 17*g*, for example, such that the orifice 176*g* is substantially closed. In a second position (e.g., the position depicted in FIG. 14*a*), the intermediate element 13*g* may be located such that the duct 15*g* is substantially disengaged from the second portion 171*g* of the adaptor 17*g* such that the orifice 176*g* is substantially open, thereby resulting in the cavity 30*f* being in communication with the interior of the container 10*g* via a passage 139*g*. The intermediate element 13*g* may be moved to intermediate positions, for example, in order to vary the cross-section of the passage 139*g*, thereby enabling a user to vary the rate with which the product P is conveyed (e.g., flows) into the cavity 30*g*.

FIG. 15 depicts an exemplary embodiment of a device for applying a product that may include a container 10*h* having a body 11*h*. An intermediate element 13*h* including a duct 15*h* may be mounted on the container 10*h* and may have an applicator 20*h* positioned thereon. A cap 40*h* configured to be mounted on the intermediate element 13*h* for enclosing the applicator 20*h* in a substantially hermetic fashion may include a reflective surface 301 (e.g., a mirror) located on, for example, an upper surface thereof. The reflective surface 301 may be useful for a user of the device to view herself/himself when applying a product (e.g., a cosmetic product) to an external body portion.

FIG. 16 depicts an exemplary embodiment of a device for applying a product that may include a container 10*i* (e.g., a tube) having a body 11*i* and a duct 15*i* with an applicator 20*i* mounted thereon. The container 10*i* and the duct 15*i* may be defined, for example, by a single piece of material, which may be formed, for example, via blow molding. Alternatively, a multi-part construction, for example, welded parts, may be used.

FIG. 17 depicts an exemplary embodiment of a device that may include a container 10*j* having a body 11*j* configured, for example, to conform to the hand of a user. This may enable the user to more easily apply product to areas of the body (e.g., when the product is a cosmetic product). The device may include a duct 15*j* having an applicator 20*j* mounted thereon. The container 10*j* and the duct 15*j* may be defined, for example, by a single piece of material, which may be formed, for example, via blow molding. Alternatively, a multi-part construction, for example, welded parts, may be used.

In some embodiments, for example, the embodiment depicted in FIG. 17, the duct 15*j* may define an axis X that is different from the axis X' defined by the container 10*j*. *For example, the axis X and the axis X' may be oriented at a non-zero angle a relative to one another. Alternatively, the axis X and the axis X' may be parallel, but not coincident with one another.*

The device according to some exemplary embodiments of the invention may be used to apply cosmetic products, such as care products, make-up products, dermatological substances, and/or pharmaceutical compositions used for treating and/or changing the appearance of, for example, hair, skin, and/or nails. However, in its broadest aspects, the present invention could be used to apply many other products.

Furthermore, sizes and configurations of various structural parts and materials used to make the above-mentioned parts are illustrative and exemplary only, and one of ordinary skill in the art would recognize that these sizes, configurations and materials can be changed to produce different effects or desired characteristics. For example, the dimension of the cross-section of the container and/or the applicator may be increased or reduced. The system for applying a product may have any shape, for example, the shape of a jar or a bottle.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a product, the device comprising:

a container configured to contain a product;

a duct associated with the container, the duct defining an axis and a passage in permanent communication with the container; and an applicator, the applicator comprising material permeable to the product and defining an axial length, the applicator comprising a side wall, a substantially closed first end defining an application surface, and an open second end, wherein the applicator and the container are intended to be coupled together, wherein at least a portion of the axial length of the applicator is located around the duct, wherein the applicator is configured such that, when the applicator and the container are coupled together and there is an absence of axial stress exerted on the application surface, a) at least one cavity is formed between a free end of the duct and an internal surface of the applicator facing the free end of the duct, and b) at least one portion of the applicator lies above the at least one cavity and has a thickness along a direction of the axis of the duct that is less than the thickness of the side wall in a direction substantially perpendicular to the axis of the duct, wherein the device is configured so that the at least one cavity defines a volume capable of varying, and wherein the duct extends into the applicator along a distance greater than a thickness of the at least one portion of the applicator lying above the at least one cavity.

2. The device of claim 1, wherein the second end of the applicator is configured to be fitted to the container.

3. The device of claim 1, wherein the device is configured so that the at least one cavity defines a volume capable of varying in response to pressure exerted axially on the application surface.

4. The device of claim 1, wherein the applicator at least partially comprises a flexible, deformable structure.

5. The device of claim 1, wherein the at least one cavity is configured to retain a portion of the product via capillary action.

6. The device of claim 1, wherein the area of the largest cross-section of the at least one cavity is less than the area of the largest cross-section of the application surface.

7. The device of claim 1, wherein the duct is configured to retain a portion of the product via capillary action.

8. The device of claim 1, wherein the duct defines a side wall comprising at least one slit extending axially over at least a portion of the duct.

9. The device of claim 1, wherein the duct defines a substantially constant internal cross-section.

10. The device of claim 1, wherein the duct defines an internal cross-section and an axial length, wherein the internal cross-section varies along the axial length of the duct.

11. The device of claim 10, wherein the internal cross-section of the duct increases progressively along the axial length in a direction facing away from the cavity.

12. The device of claim 10, wherein the internal cross-section of the duct decreases progressively along the axial length in a direction facing away from the cavity.

13. The device of claim 1, wherein a lateral portion of the side wall of the applicator contacts the duct.

14. The device of claim 1, wherein a lateral portion of the side wall of the applicator is spaced from the duct.

15. The device of claim 1, further comprising an intermediate element comprising the duct, wherein the applicator and the container are coupled together via mounting of the applicator to the intermediate element.

16. The device of claim 15, wherein the intermediate element comprises a transverse wall above which a free end of the duct projects, the transverse wall being one of planar, concave, and convex.

17. The device of claim 15, wherein the intermediate element defines a compartment configured to accommodate the applicator, the intermediate element comprising one of a circular cross-section, an oval-shaped cross-section, a rectangular cross-section, and a polygonal cross-section.

18. The device of claim 17, wherein the intermediate element comprises a side wall defining an axial length, wherein the side wall of the intermediate element at least partially holds the applicator on the intermediate element.

19. The device of claim 15, wherein the intermediate element is fitted onto the container such that it can be moved between at least a first position in which the product flows from the container into the cavity at a first flow rate and a second position in which the product flows from the container into the cavity at a second flow rate.

20. The device of claim 19, wherein the second flow rate is zero.

21. The device of claim 19, further comprising a hollow adaptor mounted on the container, the hollow adaptor comprising a lateral orifice, wherein the duct is configured to close the lateral orifice when the intermediate element is in the second position.

22. The device of claim 15, wherein the intermediate element comprises a single-piece construction.

23. The device of claim 1, wherein the container and the duct are defined by a single piece of material.

24. The device of claim 1, wherein the applicator comprises at least one passage opening to the application surface, wherein the at least one passage is configured to have a closed at rest position.

25. The device of claim 24, wherein the at least one passage of the applicator comprises at least one of at least one thin channel and at least one slit.

26. The device of claim 1, wherein the applicator comprises a substantially rigid material.

27. The device of claim 26, wherein the applicator comprises at least one material selected from frits, frits of polyvinyl chlorides, frits of ethylene vinyl acetates, frits of polyethylenes, frits of polyethylene terephthalates, and frits of polyamides.

28. The device of claim 1, wherein the applicator at least partially comprises an elastically compressible material.

29. The device of claim 28, wherein the applicator at least partially comprises at least one foam selected from closed cell foams, open cell foams, semi-open foams, polyurethane foams, polyethylene foams, polyvinyl chloride foams, polyether foams, polyester foams, NBR foams, and SBR foams.

30. The device of claim 29, wherein the applicator at least partially comprises layers of the at least one foam, the layers being at least one of welded to one another and adhesively secured to one another.

31. The device of claim 1, further comprising a removable closure component configured to hermetically enclose the application surface of the applicator.

32. The device of claim 31, wherein the removable closure component comprises one of a screw-fastened cap, a snap-fastened cap, and a hinged lid.

33. The device of claim 31, wherein an internal surface of the applicator contacts a free end of the duct so as to close the passage of the duct in a substantially hermetic fashion when the removable closure component is in a closed position.

34. A device for applying a product, the device comprising:

a container configured to contain a product;

a duct associated with the container, the duct defining an axis and a passage in one of selective and permanent communication with the container;

an applicator, the applicator comprising material permeable to the product and defining an axial length, the applicator comprising a side wall, a substantially closed first end defining an application surface, and an open second end; and a removable closure component, wherein the applicator and the container are intended to be coupled together, wherein at least a portion of the axial length of the applicator is located around the duct, wherein the applicator is configured such that, when the applicator and the container are coupled together and there is an absence of axial stress exerted on the application surface, a) at least one cavity is formed between a free end of the duct and an internal surface of the applicator facing the free end of the duct, and b) at least one portion of the applicator lies above the at least one cavity and has a thickness along a direction of the axis of the duct that is less than the thickness of the side wall in a direction substantially perpendicular to the axis of the duct, wherein the device is configured so that the at least one cavity defines a volume capable of varying, wherein the applicator at least partially comprises an elastically compressible material, wherein the applicator is at least partially compressed when the removable closure component is in a closed position, and wherein the duct extends into the applicator along a distance greater than a thickness of the at least one portion of the applicator lying above the at least one cavity.

35. The device of claim 34, wherein the applicator is formed of a single-piece construction.

36. The device of claim 34, wherein the container comprises rigid material.

37. The device of claim 34, wherein the duct comprises a first part extending into the applicator and a second part not extending into the applicator.

38. The device of claim 1, wherein the application surface is configured to move axially between a first position in which the application surface extends beyond an opening defined by a free edge of a portion of the device and a second position in which the application surface does not extend beyond the free edge.

39. The device of claim 38, further comprising an elastically compressible element configured to enable the application surface to move between its first position and its second position, the elastically compressible element having a compressibility which is greater than a compressibility of at least a portion of the applicator.

40. The device of claim 39, wherein the elastically compressible element and the applicator are not defined by a single piece of material.

41. The device of claim 40, wherein the elastically compressible element comprises at least one block of elastically deformable material.

42. The device of claim 41, wherein the elastically compressible element comprises at least one of at least one block of open cell foam and at last one block of semi-open cell foam.

43. The device of claim 39, wherein the elastically compressible element comprises a spring.

44. The device of claim 43, wherein the spring comprises at least one material selected from metals and plastics.

45. The device of claim 39, wherein at least one portion of the applicator comprises the elastically compressible element, the elastically compressible element having a compressibility greater than the compressibility of at least one other portion of the applicator.

46. The device of claim 45, wherein the applicator comprises a reinforcement located along at least a portion of the periphery of the applicator, the reinforcement being configured to provide the difference in compressibility between the applicator and the elastically compressible element.

47. The device of claim 1, wherein the applicator is removably coupled to the container via at least one of reversible adhesive bonding, magnetic attraction, and mechanical engagement.

48. The device of claim 1, wherein the applicator comprises one of a circular cross-section, an oval-shaped cross-section, and a polygonal cross-section.

49. The device of claim 1, wherein the applicator defines a cross-section comprising at least of one of a concave profile and a convex profile.

50. The device of claim 43, wherein the applicator defines a cross-section comprising a dome-shaped profile.

51. The device of claim 1, wherein the second end of the applicator defines a cross-section comprising one of a substantially planar profile, a concave profile, and a convex profile.

52. The device of claim 1, wherein the applicator comprises an agent configured to at least one of absorb a fluid and retain a fluid.

53. The device of claim 1, wherein the applicator is configured to increase in volume when loaded with product.

54. The device of claim 1, wherein the container comprises a body having at least one of at least one rigid wall and at least one semi-rigid wall.

55. The device of claim 54, wherein the body comprises at least one material selected from metals, glasses, thermoplastic materials, polyethylenes, polypropylenes, polyvinyl chlorides, polyethylene terephthalates, and thermosetting materials.

56. The device of claim 55, wherein the device is configured to contain a product at about atmospheric pressure.

57. The device of claim 1, further comprising at least one mobile element contained in the container, the at least one mobile element being configured to promote at least one of homogenization of the product and flow of the product through the passage.

58. The device of claim 57, wherein the at least one mobile element comprises at least one of at least one ball and at least one weight.

59. The device of claim 57, further comprising a structure configured to prevent the at least one mobile element from closing the passage.

60. The device of claim 59, wherein the structure comprises at least one of at least one bead and at least one fin arranged around the passage.

61. The device of claim 1, wherein the container is in the form of a tube and includes at least one side wall, wherein the applicator extends away from the at least one side wall of the container.

62. A system for applying a product, the system comprising:

the device of claim 1; and a product contained in the container.

63. The system of claim 62, wherein the product comprises a cosmetic product.

64. The system of claim 63, wherein the cosmetic product comprises one of a nail varnish, a liquid lip colorant, a cream, a lotion, an oil, a make-up remover, a nail product remover, a liquid foundation, a coloring composition, a bleaching composition, and a permer.

65. The system of claim 62, wherein the product comprises one of an adhesive, a correction fluid, a stain remover, and a polish.

66. The system of claim 62, wherein the product contained in the container is at substantially atmospheric pressure.

67. A method for applying a product, the method comprising:

providing the system of claim 62;

causing at least a portion of the product to be conveyed from an interior of the container to the cavity; and contacting the application surface to a region so as to apply the product to the region.

68. A method for applying a product, the method comprising:

providing a system for applying a product, the system comprising a device for applying a product, the device comprising a container configured to contain a product, a product contained in the container, a duct associated with the container, the duct defining an axis and a passage in one of selective and permanent communication with the container, and an applicator, the applicator comprising material permeable to the product and defining an axial length, the applicator comprising a side wall, a substantially closed first end defining an application surface, and an open second end, wherein the applicator and the container are intended to be coupled together, wherein at least a portion of the axial length of the applicator is located around the duct, wherein the applicator is configured such that, when the applicator and the container are coupled together and there is an absence of axial stress exerted on the application surface, a) at least one cavity is formed between a free end of the duct and an internal surface of the applicator facing the free end of the duct, and b) at least one portion of the applicator lies above the at least one cavity and has a thickness along a direction of the axis of the duct that is less than the thickness of the side wall in a direction substantially perpendicular to the axis of the duct, and wherein the device is configured so that the at least one cavity defines a volume capable of varying;

causing at least a portion of the product to be conveyed from an interior of the container to the cavity; and contacting the application surface to a region so as to apply the product to the region, wherein causing at least a portion of the product to be conveyed to the cavity comprises shaking the system.

69. The method of claim 67, wherein the product comprises a cosmetic product.

70. The method of claim 67, further comprising varying the rate of product transferred onto the region as a function of the pressure exerted on the application surface.

71. The device of claim 1, wherein the applicator is formed of a single-piece construction.

72. The device of claim 1, wherein the container comprises rigid material.

73. The device of claim 1, wherein the duct comprises a first part extending into the applicator and a second part not extending into the applicator.

74. A device for applying a product, the device comprising:

a container configured to contain a product;

a duct defining an axis and a passage in permanent communication with the container; and an applicator, the applicator comprising flexible material permeable to the product and defining an axial length, the applicator comprising a side portion, a substantially closed first end defining an application surface, and an open second end, wherein the applicator and the container are intended to be coupled together, wherein a portion of the applicator encircles the duct, wherein the applicator is configured such that, when the applicator and the container are coupled together and there is an absence of axial stress exerted on the application surface, a) a cavity is defined partially by an internal surface of the applicator facing the free end of the duct, and b) a portion of the applicator lies above the cavity and has a thickness along a direction of the axis of the duct that is less than the thickness of the side portion in a direction substantially perpendicular to the axis of the duct, wherein the device is configured so that the cavity defines a volume capable of varying, and wherein the duct extends into the applicator along a distance greater than a thickness of the portion of the applicator lying above the cavity.

75. The device of claim 74, wherein the container comprises rigid material.

76. The device of claim 74, wherein the applicator is formed of a single-piece construction.

77. The device of claim 74, wherein the duct comprises a first part extending into the applicator and a second part not extending into the applicator.

78. The device of claim 74, wherein, in the absence of axial stress exerted on the application surface, the portion of the applicator that encircles the duct contacts the duct.

79. A device for applying a cosmetic product, the device comprising:

a container containing the cosmetic product, the container comprising a neck and being defined by a single piece of material;

an applicator component comprising flexible material; and an intermediate element for associating the applicator component with the container, the intermediate element defining a passage for transferring cosmetic product from the container to the applicator component, the intermediate element defining a first portion extending into the container and a second portion extending out of the container, the second portion having a length greater than a length of the first portion;

wherein the passage comprises a tubular duct configured to provide permanent communication between the container and the applicator component, and the tubular duct extends into the neck of the container, and wherein the applicator component and the intermediate element define a cavity located between an end of the tubular duct and an interior portion of the applicator component.

80. The device of claim 79, wherein the intermediate element and the container are configured to engage one another.

81. The device of claim 80, wherein the intermediate element and the container are configured engage one another via threads.

82. The device of claim 79, wherein the intermediate element and the applicator component are configured to engage one another.

83. The device of claim 79, wherein the intermediate element is impermeable to the cosmetic product.

84. The device of claim 79, wherein applicator component encircles a portion of the intermediate element.

85. The device of claim 79, wherein the applicator component is formed of a single-piece construction.

86. The device of claim 79, wherein the container comprises rigid material.

87. A device for applying a cosmetic product, the device comprising:

a container containing the cosmetic product, the container comprising a neck and being defined by a single piece of material;

an applicator comprising flexible material; and a tubular duct providing permanent communication between the container and the applicator, the tubular duct defining a first portion extending into the neck of the container and a second portion extending out of the neck of the container, wherein the second portion has a length greater than a length of the first portion, wherein a cavity is formed between an end of the tubular duct and an interior portion of the applicator.

88. The device of claim 87, wherein the applicator contacts and surrounds the second portion of the tubular duct.

89. The device of claim 87, wherein the applicator defines an annular groove.

90. The device of claim 87, further comprising an intermediate element for associating the applicator with the container.

91. The device of claim 90, wherein applicator and the intermediate element are configured to engage one another.

92. The device of claim 90, wherein the intermediate element and the container are configured to engage one another.

93. The device of claim 92, wherein the intermediate element and the container are configured to engage one another via threads.

94. The device of claim 87, wherein the applicator is formed of a single-piece construction.

95. The device of claim 87, wherein the container comprises rigid material.

96. A device for applying a product, the device comprising:

a container for containing the product;

an applicator comprising flexible material, the applicator defining a perimeter and a groove extending along the perimeter; and a tubular duct extending in the applicator and defining a passage in permanent communication with the container, the tubular duct defining a first portion extending into the container and a second portion extending out of the container, wherein the second portion has a length greater than a length of the first portion, wherein a cavity is formed between an end of the tubular duct and an interior portion of the applicator.

97. The device of claim 96, wherein the tubular duct is formed of a material more rigid than the flexible material of the applicator.

98. The device of claim 96, wherein the groove has an annular shape.

99. The device of claim 96, wherein the applicator is formed of a single-piece construction.

100. The device of claim 96, wherein the container comprises rigid material.

101. The device of claim 96, wherein the duct comprises a first portion that does not extend into the applicator.

102. A device for applying a product, the device comprising:

a container configured to contain a product;

an intermediate element moveable with respect to the container, wherein the intermediate element comprises a duct defining an axis and a passage intended to provide communication with the container; and an applicator connected to the intermediate element, the applicator comprising flexible, elastically compressible material permeable to the product and defining an axial length, the applicator comprising a side portion, a substantially closed first end defining an application surface, and an open second end, wherein the flexible material of the applicator encircles the duct, and wherein the applicator is configured such that, a) a cavity is defined by an internal surface of the applicator and the intermediate element, and b) a portion of the applicator lies above the cavity and has a thickness along a direction of the axis of the duct that is less than the thickness of the side portion in a direction substantially perpendicular to the axis of the duct, wherein the device is configured so that the passage is placed in selective communication with the container by moving the intermediate element with respect to container.

103. The device of claim 102, wherein the applicator is formed of a single-piece construction.

104. The device of claim 102, wherein the container comprises rigid material.

105. A device for applying a product, the device comprising:

a container configured to contain a product;

a duct defining an axis and a passage in communication with the container; and an applicator, the applicator comprising flexible material permeable to the product and defining an axial length, the applicator comprising a side portion, a substantially closed first end defining an application surface, and an open second end, wherein the applicator and the container are intended to be coupled together, wherein a portion of the applicator encircles the duct, wherein the applicator is configured such that, when the applicator and the container are coupled together and there is an absence of axial stress exerted on the application surface, a) a cavity is defined partially by an internal surface of the applicator facing the free end of the duct, and b) a portion of the applicator lies above the cavity and has a thickness along a direction of the axis of the duct that is less than the thickness of the side portion in a direction substantially perpendicular to the axis of the duct, wherein the device is configured so that the cavity defines a volume capable of varying, wherein the device lacks a valving structure controlling flow of product from the container to the applicator, and wherein the duct extends into the applicator along a distance greater than a thickness of the portion of the applicator lying above the cavity.

106. The device of claim 105, wherein the applicator comprises compressible material.

107. The device of claim 105, wherein the applicator is formed of a single-piece construction.

108. The device of claim 105, wherein the container comprises rigid material.

109. The device of claim 105, wherein the duct comprises a first part extending into the applicator and a second part not extending into the applicator.

110. The device of claim 105, wherein, in the absence of axial stress exerted on the application surface, the portion of the applicator that encircles the duct contacts the duct.

111. A device for applying a product, the device comprising:

a container configured to contain a product;

a duct associated with the container, the duct defining an axis and a passage in permanent communication with the container; and an applicator, the applicator comprising material permeable to the product and defining an axial length, the applicator comprising a side wall, a substantially closed first end defining an application surface, and an open second end, wherein the applicator and the container are intended to be coupled together, wherein at least a portion of the axial length of the applicator is located around the duct, wherein the applicator is configured such that, when the applicator and the container are coupled together and there is an absence of axial stress exerted on the application surface, a) at least one cavity is formed between a free end of the duct and an internal surface of the applicator facing the free end of the duct, and b) at least one portion of the applicator lies above the at least one cavity and has a thickness along a direction of the axis of the duct that is less than the thickness of the side wall in a direction substantially perpendicular to the axis of the duct, wherein the device is configured so that the at least one cavity defines a volume capable of varying, and wherein the duct extends into the applicator a distance greater than a height of the at least one cavity along the direction of the axis of the duct.

112. The device of claim 111, wherein the applicator is formed of a single-piece construction.

113. The device of claim 111, wherein the container comprises rigid material.

114. The device of claim 1, wherein, in the absence of axial stress exerted on the application surface, the portion of the axial length of the applicator located around the duct contacts the duct.

115. The device of claim 111, wherein, in the absence of axial stress exerted on the application surface, the portion of the applicator located around the duct contacts the duct.

* * * * *

UNITED STATES PATENT AND TRADEMARK OFFICE

CERTIFICATE OF CORRECTION

PATENT NO. : 7,125,189 B2
APPLICATION NO. : 10/298609
DATED : October 24, 2006
INVENTOR(S) : Jean-Louis H. Gueret It is certified that error appears in the above-identified patent and that said Letters Patent is hereby corrected as shown below:

Column 22, line 51, "claim 43," should read --claim 49,--.

Column 25, line 38, "configured engage" should read --configured to engage--.

Signed and Sealed this

Ninth Day of January, 2007

JON W. DUDAS
*Director of the United States Patent and Trademark Office*